US009389521B2

(12) United States Patent
Takahashi et al.

(10) Patent No.: US 9,389,521 B2
(45) Date of Patent: Jul. 12, 2016

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Koji Takahashi, Kashiwa (JP); Takahiro Mitsui, Kawasaki (JP); Naoaki Ichihashi, Kashiwa (JP); Yasuhiro Kawai, Abiko (JP); Hideki Ogawa, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/622,568

(22) Filed: Feb. 13, 2015

(65) Prior Publication Data

US 2015/0241799 A1 Aug. 27, 2015

(30) Foreign Application Priority Data

Feb. 21, 2014 (JP) ..... 2014-032157
Jan. 28, 2015 (JP) ..... 2015-014329

(51) Int. Cl.

| | |
|---|---|
| ***G03G 5/147*** | (2006.01) |
| ***G03G 5/04*** | (2006.01) |
| ***G03G 5/043*** | (2006.01) |
| ***G03G 5/05*** | (2006.01) |

(52) U.S. Cl.

CPC ..... *G03G 5/04* (2013.01); *G03G 5/043* (2013.01); *G03G 5/05* (2013.01); *G03G 5/0564* (2013.01); *G03G 5/147* (2013.01)

(58) Field of Classification Search

CPC ..... G03G 5/147; G03G 5/14708

See application file for complete search history.

(56) References Cited

U.S. PATENT DOCUMENTS

| | | | |
|---|---|---|---|
| 7,097,953 | B2 | 8/2006 | Ogawa et al. |
| 7,186,489 | B2 | 3/2007 | Uematsu et al. |
| 7,226,711 | B2 | 6/2007 | Amamiya et al. |
| 7,534,534 | B2 | 5/2009 | Nakata et al. |
| 7,813,675 | B2 | 10/2010 | Tanabe et al. |
| 2011/0070537 | A1 | 3/2011 | Sumitani et al. |
| 2013/0221560 | A1 | 8/2013 | Kawai et al. |
| 2014/0093281 | A1 | 4/2014 | Takahashi et al. |

FOREIGN PATENT DOCUMENTS

| | | | | |
|---|---|---|---|---|
| JP | 2011-90296 | A | 5/2011 | |
| JP | 5127991 | B1 | 1/2013 | |
| WO | WO 2012/165642 | * | 12/2012 | ..... G03G 5/147 |

* cited by examiner

*Primary Examiner* — Hoa V Le

(74) *Attorney, Agent, or Firm* — Fitzpatrick, Cella, Harper and Scinto

(57) ABSTRACT

Provided is an electrophotographic photosensitive member in which a surface of the electrophotographic photosensitive member has: a plurality of specific depressed portions; and a plurality of specific line grooves formed at portions other than the specific depressed portions, and in which when a square region 500 μm on a side is arranged at an arbitrary position of the surface of the electrophotographic photosensitive member, an area of the plurality of depressed portions in the square region 500 μm on a side is 95,000 $\mu m^2$ or more and 180,000 $\mu m^2$ or less.

18 Claims, 6 Drawing Sheets

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a process cartridge, and an electrophotographic apparatus.

2. Description of the Related Art

A surface of an electrophotographic photosensitive member is subjected to an external electric force or external mechanical force caused by charging, cleaning, or the like, and hence is required to have durability against such external force (such as wear resistance).

To meet the requirement, hitherto, there has been used an improving technology involving, for example, using a resin having high wear resistance (such as a curable resin) in a surface layer of the electrophotographic photosensitive member.

Meanwhile, problems resulting from an increase in wear resistance of the surface of the electrophotographic photosensitive member include image smearing and a reduction in cleaning performance.

A possible cause for the image smearing is a reduction in resistance of the surface of the electrophotographic photosensitive member. Possible causes for the reduction in resistance of the surface of the electrophotographic photosensitive member are: deterioration of a material used in the surface layer of the electrophotographic photosensitive member due to an oxidizing gas, such as ozone or a nitrogen oxide, generated by charging of the surface of the electrophotographic photosensitive member; and adsorption of moisture onto the surface of the electrophotographic photosensitive member. In particular, as the wear resistance of the surface of the electrophotographic photosensitive member increases, it becomes more difficult to refresh the surface of the electrophotographic photosensitive member (to remove the deteriorated material, the adsorbed moisture, or the like), and the image smearing becomes more liable to occur.

As a technology for suppressing the image smearing, Japanese Patent No. 5127991 describes that on the surface of the electrophotographic photosensitive member, depressed portions each having a depth of 0.5 μm or more and 5 μm or less and a longest diameter of an opening of 20 μm or more and 80 μm or less are formed so that the area of the depressed portions in a square region 500 μm on a side may be 10,000 $\mu m^2$ or more and 90,000 $\mu m^2$ or less, and a flat part contained in a portion other than the depressed portions is formed so that its area may be 80,000 $\mu m^2$ or more and 240,000 $\mu m^2$ or less. This can improve dot reproducibility even when the electrophotographic photosensitive member is left to stand under a high-temperature and high-humidity environment.

In addition, as a technology for improving the cleaning performance, Japanese Patent Application Laid-Open No. 2011-90296 describes a technology involving causing the surface of the electrophotographic photosensitive member to have an uneven shape having a plurality of depressed portions and a plurality of protruded portions, and controlling a surface roughness Rz of a top surface of the protruded portions so as to be 0.01 μm or more and 0.5 μm or less.

However, the technology described in Japanese Patent No. 5127991, though having a significant ameliorating effect on the image smearing, still has room for improvement in that when image output is performed under a low-humidity environment for a long period of time (on about 20,000 sheets), a streak-like image defect (hereinafter sometimes referred to as "low-humidity streak") may be generated.

The inventors of the present invention have made an attempt to ameliorate the low-humidity streak by forming depressed portions each having a depth 0.5 μm or more and 5 μm or less and a longest diameter of an opening of 20 μm or more and 80 μm or less on the surface of the electrophotographic photosensitive member so that the area of the depressed portions in a square region 500 μm on a side may be 95,000 $\mu m^2$ or more.

However, it has been found that there is room for improvement in that when an image having a low print percentage (about 1%) is output for a short period of time (on about 200 sheets) under a high-temperature and high-humidity environment, a streak-like image defect (hereinafter sometimes referred to as "high-temperature/humidity streak") may be generated on a halftone image having a density of about 30% output thereafter.

Also in the case of using the technology described in Japanese Patent Application Laid-Open No. 2011-90296, no suppressive effect on the high-temperature/humidity streak has been able to be observed.

SUMMARY OF THE INVENTION

An object of the present invention is to provide an electrophotographic photosensitive member capable of suppressing the occurrence of a low-humidity streak and a high-temperature/humidity streak, and a process cartridge and an electrophotographic apparatus each including the electrophotographic photosensitive member.

According to one embodiment of the present invention, there is provided an electrophotographic photosensitive member, including:

a cylindrical support; and a photosensitive layer formed on the support, in which a surface of the electrophotographic photosensitive member has:

a plurality of depressed portions each having a depth of 0.5 μm or more and 5 μm or less and a longest diameter of an opening of 20 μm or more and 80 μm or less; and a plurality of line grooves formed at portions other than the plurality of depressed portions, the plurality of line grooves each having a width in a generatrix line direction of the electrophotographic photosensitive member of 0.5 μm or more and 15 μm or less and forming an angle of 80° or more and 100° or less with respect to the generatrix line direction, and in which when a square region 500 μm on a side is arranged at an arbitrary position of the surface of the electrophotographic photosensitive member, an area of the plurality of depressed portions in the square region 500 μm on a side is 95,000 $\mu m^2$ or more and 180,000 $\mu m^2$ or less.

In addition, according to one embodiment of the present invention, there is provided an electrophotographic photosensitive member, including:

a cylindrical support; and a photosensitive layer formed on the support, in which at least a contact area with a cleaning blade of a surface of the electrophotographic photosensitive member has:

a plurality of depressed portions each having a depth of 0.5 μm or more and 5 μm or less and a longest diameter of an opening of 20 μm or more and 80 μm or less; and a plurality of line grooves formed at portions other than the plurality of depressed portions, the plurality of line grooves each having a width in a generatrix line direction of the electrophotographic photosensitive member of 0.5 μm or more and 15 μm or less and forming an angle of 80° or more and 100° or less with respect to the generatrix line direction, and in which when a square region 500 μm on a side is arranged at an arbitrary position of the contact area, an area of the plurality of depressed portions in the square region 500 μm on a side is 95,000 $\mu m^2$ or more and 180,000 $\mu m^2$ or less.

Further, according to one embodiment of the present invention, there is provided a process cartridge, including: the electrophotographic photosensitive member; and a cleaning unit including a cleaning blade arranged so as to be brought into contact with the electrophotographic photosensitive member, the electrophotographic photosensitive member and the cleaning unit being integrally supported, in which the process cartridge is removably mounted onto a main body of an electrophotographic apparatus.

In addition, according to one embodiment of the present invention, there is provided an electrophotographic apparatus, including: the electrophotographic photosensitive member; a charging unit; an exposing unit; a developing unit; a transferring unit; and a cleaning unit including a cleaning blade arranged so as to be brought into contact with the electrophotographic photosensitive member.

According to embodiments of the present invention, it is possible to provide the electrophotographic photosensitive member capable of suppressing the occurrence of a low-humidity streak and a high-temperature/humidity streak, and the process cartridge and the electrophotographic apparatus each including the electrophotographic photosensitive member.

Further features of the present invention will become apparent from the following description of exemplary embodiments with reference to the attached drawings.

BRIEF DESCRIPTION OF THE DRAWINGS

FIG. 2 is a diagram schematically illustrating a relationship among a reference plane, depressed portions, and the like.

DESCRIPTION OF THE EMBODIMENTS

Figure 1:
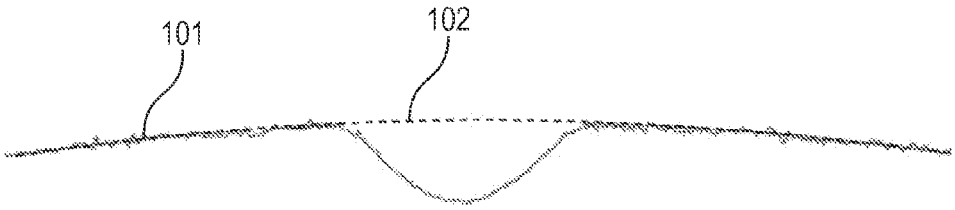
FIG. 1 is a diagram illustrating an example of fitting.

Preferred embodiments of the present invention will now be described in detail in accordance with the accompanying drawings.

An electrophotographic photosensitive member of the present invention has, on its surface, a plurality of specified depressed portions and a plurality of specified line grooves. Herein, the specified depressed portions refer to depressed portions each having a depth of 0.5 μm or more and 5 μm or less and a longest diameter of an opening of 20 μm or more and 80 μm or less. The specified depressed portions are hereinafter sometimes referred to as "specific depressed portions". The specific depressed portions are formed on the surface of the electrophotographic photosensitive member of the present invention so that when a square region 500 μm on a side is arranged at an arbitrary position thereof, the area of the specific depressed portions in the square region 500 μm on a side may be 95,000 $\mu m^2$ or more and 180,000 $\mu m^2$ or less.

In addition, the specified line grooves refer to line grooves each having a width in the generatrix line direction of the electrophotographic photosensitive member of 0.5 μm or more and 15 μm or less and forming an angle of 80° or more and 100° or less with respect to the generatrix line direction. The specified line grooves are hereinafter sometimes referred to as "specific line grooves". In the surface of the electrophotographic photosensitive member of the present invention, the specific line grooves are formed at portions of the surface of the electrophotographic photosensitive member other than the specific depressed portions.

As a result of studies made by the inventors of the present invention, it has been found that the occurrence of a low-humidity streak can be suppressed when the surface of the electrophotographic photosensitive member has densely arranged thereon the specific depressed portions each having a large longest diameter of an opening, and has the specific line grooves formed at portions other than the specific depressed portions.

When the specific depressed portions, each having a large longest diameter of an opening, are densely formed, large torsion or vibration (chatter vibration) in the longitudinal direction of a cleaning blade is suppressed. This stabilizes rubbing between the electrophotographic photosensitive member and the cleaning blade even under a low-humidity environment, i.e., an environment having a high load on the cleaning blade, thereby reducing the deterioration of the cleaning blade even in the case where image output is performed for a long period of time. That is, the behavior of the cleaning blade can be stably maintained over a long period of time to suppress the low-humidity streak.

Further, when the specific line grooves are formed at portions of the surface of the electrophotographic photosensitive member other than the specific depressed portions, the behavior of the cleaning blade in a microscale region becomes more stable. Thus, the stability of the rubbing state between the cleaning blade and the electrophotographic photosensitive member improves. As a result, a memory that may be generated owing to a substance adhered to the surface of the electrophotographic photosensitive member or instability of the rubbing state between the cleaning blade and the electrophotographic photosensitive member is suppressed, and a high-temperature/humidity streak is suppressed.

Specifically, the surface of the electrophotographic photosensitive member of the present invention has a plurality of depressed portions (specific depressed portions) formed thereon each having a depth of 0.5 μm or more and 5 μm or less and a longest diameter of an opening of 20 μm or more and 80 μm or less. In addition, the specific depressed portions are formed on the surface of the electrophotographic photosensitive member so that when a square region 500 μm on a side is arranged at an arbitrary position of the surface of the electrophotographic photosensitive member, the area of the specific depressed portions in the square region may be 95,000 $\mu m^2$ or more and 180,000 $\mu m^2$ or less.

Alternatively, at least a contact area with the cleaning blade of the surface of the electrophotographic photosensitive member of the present invention has a plurality of depressed portions (specific depressed portions) formed thereon each having a depth of 0.5 μm or more and 5 μm or less and a longest diameter of an opening of 20 μm or more and 80 μm or less. In addition, the specific depressed portions are formed on the surface of the electrophotographic photosensitive member so that when a square region 500 μm on a side is arranged at an arbitrary position of the contact area, the area of the specific depressed portions in the square region may be 95,000 $\mu m^2$ or more and 180,000 $\mu m^2$ or less.

The area of the square region is 250,000 $\mu m^2$.

Herein, the arbitrary position means that the area of the specific depressed portions falls within the above-mentioned range, at whatever position of the surface of the electrophotographic photosensitive member (or the contact area) the square region 500 μm on a side is arranged.

In addition, the electrophotographic photosensitive member of the present invention has a cylindrical shape, and hence the surface (peripheral surface) of the electrophotographic photosensitive member is a curved surface curved in a circumferential direction. To "arrange a square region 500 μm on a side at an arbitrary position of the surface of the electrophotographic photosensitive member" means that when the curved surface is corrected into a plane, such a region as to become a square in the plane is arranged at an arbitrary position of the surface of the electrophotographic photosensitive member. To "arrange a square region 500 μm on a side at an arbitrary position of the contact area with the cleaning blade of the surface of the electrophotographic photosensitive member" has a similar meaning, that is, means that when the curved surface is corrected into a plane, such a region as to become a square in the plane is arranged at an arbitrary position of the contact area.

In addition, the surface of the electrophotographic photosensitive member (or the contact area) has, at portions other than the specific depressed portions, a plurality of line grooves formed thereon each having a width in the generatrix line direction of the electrophotographic photosensitive member of 0.5 μm or more and 15 μm or less and forming an angle of 80° or more and 100° or less with respect to the generatrix line direction.

The specific depressed portions, flat part, and the like of the surface of the electrophotographic photosensitive member may be observed using, for example, a microscope such as a laser microscope, an optical microscope, an electron microscope, or an atomic force microscope.

As the laser microscope, for example, the following instruments may be utilized: an ultra-deep shape measuring microscope VK-8550, ultra-deep shape measuring microscope VK-9000, and ultra-deep shape measuring microscope VK-9500, VK-X200, or VK-X100 manufactured by KEYENCE CORPORATION; a scanning confocal laser microscope OLS 3000 manufactured by Olympus Corporation; and a real color confocal microscope OPTELICS C130 manufactured by Lasertec Corporation.

As the optical microscope, for example, the following instruments may be utilized: a digital microscope VHX-500 and digital microscope VHX-200 manufactured by KEYENCE CORPORATION; and a 3D digital microscope VC-7700 manufactured by OMRON Corporation.

As the electron microscope, for example, the following instruments may be utilized: a 3D real surface view microscope VE-9800 and 3D real surface view microscope VE-8800 manufactured by KEYENCE CORPORATION; a scanning electron microscope Conventional/Variable Pressure SEM manufactured by SII NanoTechnology Inc.; and a scanning electron microscope SUPERSCAN SS-550 manufactured by Shimadzu Corporation.

As the atomic force microscope, for example, the following instruments may be utilized: a nanoscale hybrid microscope VN-8000 manufactured by KEYENCE CORPORATION; a scanning probe microscope NanoNavi Station manufactured by SII NanoTechnology Inc.; and a scanning probe microscope SPM-9600 manufactured by Shimadzu Corporation.

The square region 500 μm on a side may be observed at a magnification at which the square region 500 μm on a side falls within the field of view, or may be partially observed at a higher magnification, followed by the combining of a plurality of partial images using software.

Now, the specific depressed portions and specific line grooves in the square region 500 μm on a side are described.

First, the surface of the electrophotographic photosensitive member is observed under magnification with a microscope. The electrophotographic photosensitive member of the present invention has a cylindrical shape, and the surface (peripheral surface) of the electrophotographic photosensitive member is a curved surface curved in a circumferential direction. Accordingly, a cross-sectional profile of the curved surface is sampled, and a curve (arc because the electrophotographic photosensitive member has a cylindrical shape) is fitted thereto. FIG. 1 illustrates an example of the fitting. In FIG. 1, a solid line 101 is the cross-sectional profile of the surface (curved surface) of the electrophotographic photosensitive member, and a dashed line 102 is the curve fitted to the cross-sectional profile 101. The cross-sectional profile 101 is corrected so that the curve 102 of the dashed line may become a straight line, and a plane obtained by extending the resultant straight line in the longitudinal direction of the electrophotographic photosensitive member (direction orthogonal to the circumferential direction) is defined as a reference plane.

A portion positioned below the resultant reference plane is defined as a depressed portion in the square region. The distance from the reference plane to the lowest point of the depressed portion is defined as the depth of the depressed portion. The cross-section of the depressed portion at the reference plane is defined as an opening, and the length of the longest line segment of line segments across the opening is defined as the longest diameter of the opening of the depressed portion. In addition, the shortest of distances between two parallel lines sandwiching the opening of the depressed portion is defined as the shortest diameter of the opening of the depressed portion. Depressed portions each of which satisfies the following fall under the category of the specific depressed portions: the thus determined depth falls within the range of from 0.5 μm or more to 5 μm or less, and the thus determined longest diameter of the opening falls within the range of from 20 μm or more to 80 μm or less. The depth of each of the specific depressed portions in the present invention is more preferably 0.5 μm or more and 3 μm or less. In addition, the shortest diameter of the opening of each of the specific depressed portions preferably falls within the range of from 20 μm or more to 80 μm or less.

The longest diameter of the opening of each of the specific depressed portions in the present invention preferably falls within the range of from 20 μm or more to 80 μm or less from the viewpoint of effectively suppressing the low-humidity streak. Further, it is more preferred that: both the longest diameter of the opening and shortest diameter of the opening of each of the specific depressed portions fall within the range of from 30 μm or more to 60 μm or less; and the area of the specific depressed portions in the above-mentioned square region be 100,000 $\mu m^2$ or more and 160,000 $\mu m^2$ or less.

In addition, when the area of the specific depressed portions is measured in the square region 500 μm on a side arranged at each of 50 arbitrary locations of the surface of the electrophotographic photosensitive member, the standard deviation of the measured values for the area of the depressed portions at the 50 locations is preferably 5% or less.

Figure 2:
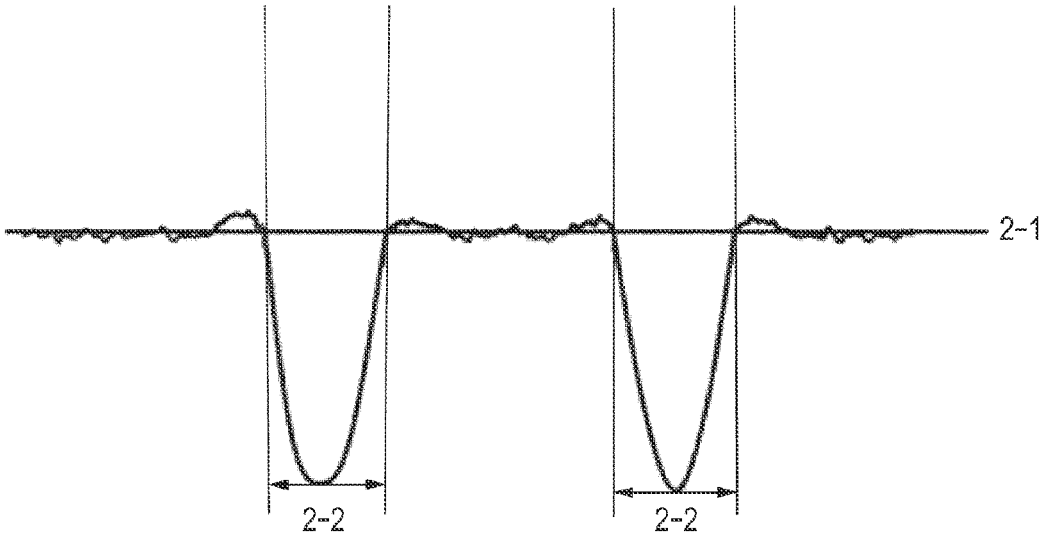
Figure 3A:
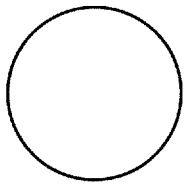
FIG. 3A, FIG. 3B, FIG. 3C, FIG. 3D, FIG. 3E, FIG. 3F, and FIG. 3G are diagrams illustrating examples of the shape of the opening of a depressed portion on the surface of an electrophotographic photosensitive member.
Figure 3B:
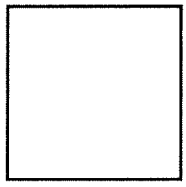
Figure 3C:
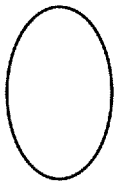
Figure 3D:
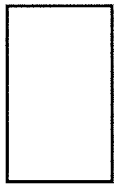
Figure 3E:
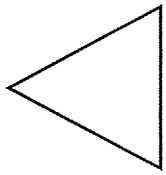
Figure 3F:
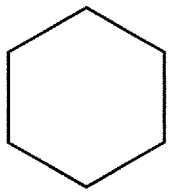
Figure 3G:
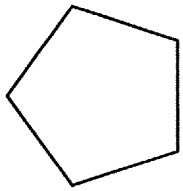

FIG. 2 schematically illustrates a relationship among a reference plane 2-1, depressed portions 2-2 (specific depressed portions), and the like. It should be noted that FIG. 2 is the cross-sectional profile after the correction (fitting).

FIG. 3A to FIG. 3G illustrate examples of the shape of the opening of the depressed portion (specific depressed portion) (shape in the case where the specific depressed portion is viewed from above).

Examples of the shape of the opening of the specific depressed portion include a circle, ellipse, square, rectangle, triangle, pentagon, and hexagon as illustrated in FIG. 3A to FIG. 3G. In addition, examples of the cross-sectional shape of the specific depressed portion include: shapes having edges, such as a triangle, a tetragon, and a polygon; a wave shape formed of a continuous curve; and a shape obtained by transforming part or all of the edges of a triangle, a tetragon, or a polygon into curves.

The plurality of specific depressed portions to be formed on the surface of the electrophotographic photosensitive member may all have the same shape, the same longest diameter of an opening, and the same depth, or may be a mixture of ones different from each other in shape, longest diameter of an opening, or depth.

The specific depressed portions may be formed on the entire surface of the electrophotographic photosensitive member, or may be formed on part of the surface of the electrophotographic photosensitive member. When the specific depressed portions are formed on part of the surface of the electrophotographic photosensitive member, it is preferred that the specific depressed portions be formed in at least the entire contact area with a cleaning blade.

Figure 4B:
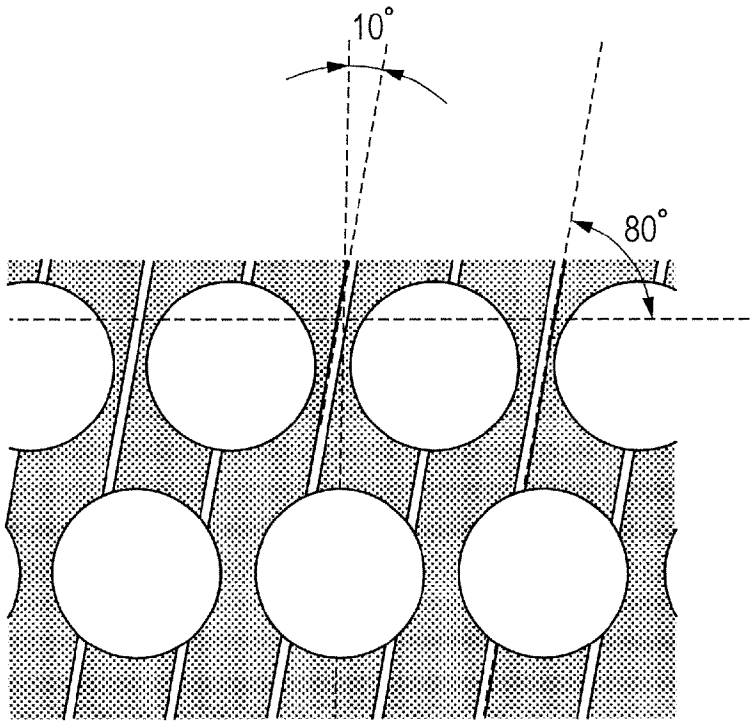
FIG. 4B is a diagram for illustrating the angle of a line groove.
Figure 4A:
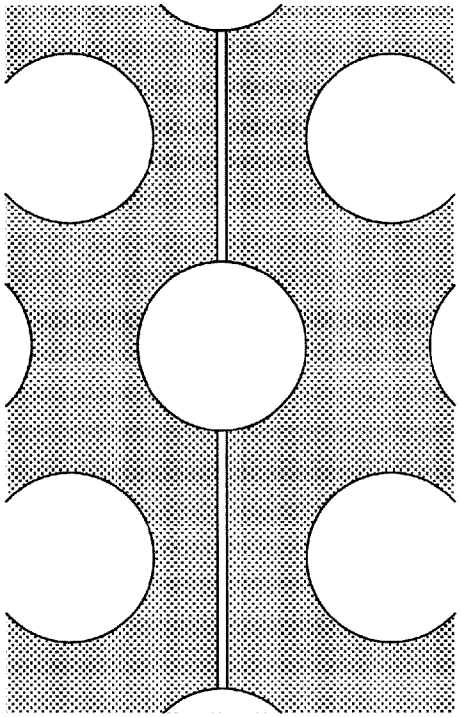
FIG. 4A is a diagram for illustrating a method of counting line grooves.

In addition, the widths, lengths, and number of the specific line grooves formed on the surface of the electrophotographic photosensitive member are also determined from the results of the observation of the surface of the electrophotographic photosensitive member described above. In the present invention, counted as the specific line grooves are ones each having a width in the generatrix line direction of the electrophotographic photosensitive member of 0.5 μm or more and 15 μm or less. It should be noted that when one line groove appears to be divided by a depressed portion as illustrated in FIG. 4A, the line groove is counted as two.

From the viewpoint of more effectively suppressing the high-temperature/humidity streak, as described above, the specific line grooves each have a width in the generatrix line direction of the electrophotographic photosensitive member of 0.5 μm or more and 15 μm or less. The surface of the electrophotographic photosensitive member may have a line groove having a width in the generatrix line direction of less than 0.5 μm, or a line groove having a width in the generatrix line direction of more than 15 μm.

In addition, in the surface of the electrophotographic photosensitive member (or the contact area), it is preferred that out of the specific line grooves, 50 or more line grooves each of which satisfies the following be present in the square region 500 μm on a side: the width in the generatrix line direction of the electrophotographic photosensitive member is 1 μm or more and 10 μm or less and the length in the circumferential direction of the electrophotographic photosensitive member is 30 μm or more.

As described above and as illustrated in FIG. 4B, in the present invention, the line grooves (specific line grooves) each form an angle of 80° or more and 100° or less with respect to the generatrix line direction of the electrophotographic photosensitive member (its slope with respect to the circumferential direction of the electrophotographic photosensitive member is within)±10°.

In addition, from the viewpoint of more effectively suppressing the high-temperature/humidity streak, the depths of the specific line grooves are preferably shallower than the depths of the specific depressed portions, and specifically, are preferably 0.01 μm or more and 0.05 μm or less on average.

<Method of Forming Depressed Portions on Surface of Electrophotographic Photosensitive Member>

The depressed portions may be formed on the surface of the electrophotographic photosensitive member by bringing a mold member (mold) having protruded portions corresponding to the depressed portions to be formed into pressure contact with the surface of the electrophotographic photosensitive member to perform shape transfer.

Figure 5:
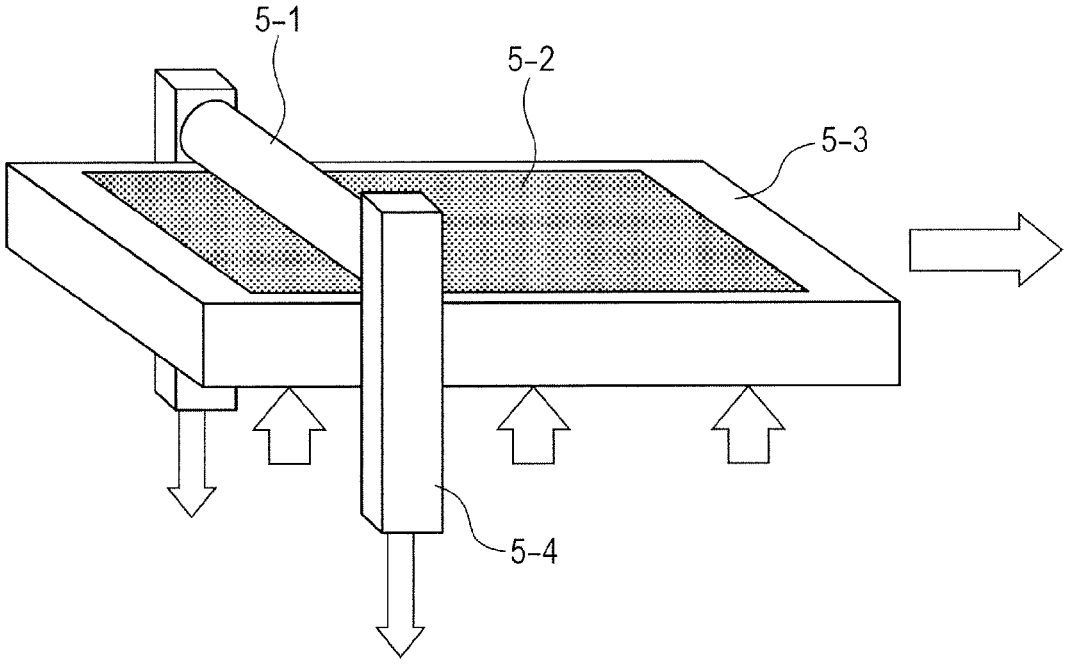
FIG. 5 is a diagram illustrating an example of a pressure-contact shape transfer processing apparatus for forming depressed portions on the surface of an electrophotographic photosensitive member.

FIG. 5 illustrates an example of a pressure-contact shape transfer processing apparatus for forming depressed portions on the surface of an electrophotographic photosensitive member.

The pressure-contact shape transfer processing apparatus illustrated in FIG. 5 is configured as follows: while an electrophotographic photosensitive member 5-1 as an object to be processed is rotated, its surface (peripheral surface) is pressurized by continuously bringing a mold 5-2 into contact therewith, and thus the depressed portions can be formed on the surface of the electrophotographic photosensitive member 5-1.

As a material for a pressurizing member 5-3, for example, there are given a metal, an alloy, a metal oxide, a plastic, and glass. Of those, Steel Use Stainless (SUS) is preferred from the viewpoints of mechanical strength, dimensional accuracy, and durability.

The mold 5-2 is provided on the top surface of the pressurizing member 5-3. By means of a support member (not shown) and pressurizing system (not shown) to be provided on the bottom surface side, the mold 5-2 can be brought into contact, at a predetermined pressure, with the surface of the electrophotographic photosensitive member 5-supported by a support member 5-4. At this time, the support member 5-4 may be pressed at a predetermined pressure against the pressurizing member 5-3, or the support member 5-4 and the pressurizing member 5-3 may be pressed at a predetermined pressure against each other.

The example illustrated in FIG. 5 is an example in which the pressurizing member 5-3 is moved in a direction perpendicular to the axis direction of the electrophotographic photosensitive member 5-1, and thus, while the electrophotographic photosensitive member 5-1 is rotated along with the movement of the pressurizing member 5-3 or driven to rotate, its surface is continuously processed. In addition, the surface of the electrophotographic photosensitive member 5-1 may be continuously processed by fixing the pressurizing member 5-3 and moving the support member 5-4 in a direction perpendicular to the axis direction of the electrophotographic photosensitive member 5-1. In addition, the surface of the electrophotographic photosensitive member 5-1 may be continuously processed by moving both the support member 5-4 and the pressurizing member 5-3.

It should be noted that from the viewpoint of efficiently performing the shape transfer, it is preferred to heat the mold 5-2 and the electrophotographic photosensitive member 5-1.

Examples of the mold 5-2 include: a metal or resin film subjected to fine surface processing; and a silicon wafer having a surface patterned with a resist. In addition, the examples also include: a resin film having dispersed thereon fine particles; and a metal-coated resin film having a fine surface shape.

In addition, from the viewpoint of making uniform the pressure to be applied to the electrophotographic photosensitive member 5-1, it is preferred to provide an elastic body between the mold 5-2 and the pressurizing member 5-3.

<Method of Forming Line Grooves on Surface of Electrophotographic Photosensitive Member>

The line grooves may be formed on the surface of the electrophotographic photosensitive member by bringing a mold member (mold) having an uneven shape corresponding to the line grooves to be formed into pressure contact with the surface of the electrophotographic photosensitive member to perform shape transfer. In addition, the line grooves may be formed on the surface of the electrophotographic photosensitive member by abrading the surface of the electrophotographic photosensitive member. In addition, the electrophotographic photosensitive member having the line grooves on its surface may be obtained by sequentially laminating layers including a photosensitive layer on a cylindrical support having a surface roughened so as to correspond to the line grooves to be formed, to thereby reflect the surface (peripheral surface) shape of the support on the surface (peripheral surface) of the electrophotographic photosensitive member. In addition, when the surface layer of the electrophotographic photosensitive member is formed by coating using an application liquid for a surface layer, the electrophotographic photosensitive member having the line grooves on its surface may be obtained by performing surface-roughening of the applied application liquid for a surface layer in a fluid state before its complete drying (curing).

Figure 6:
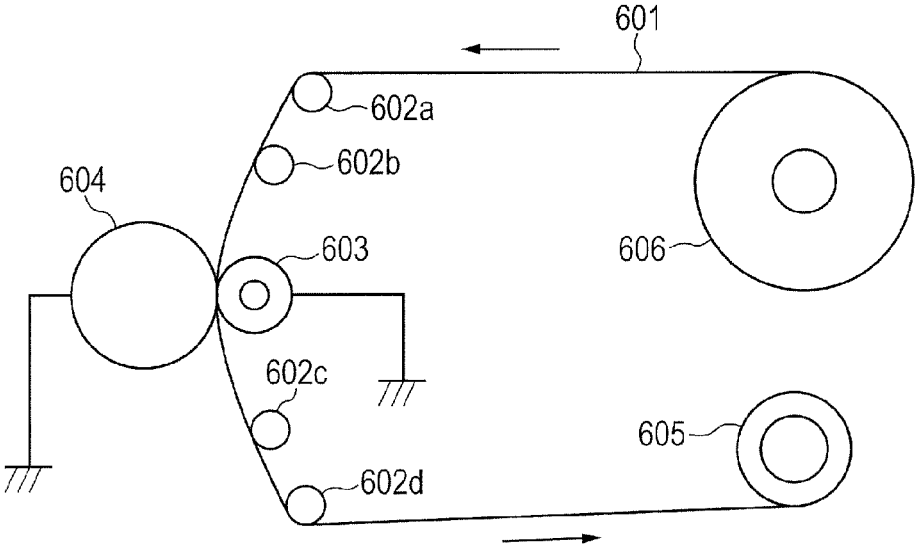
FIG. 6 is a diagram illustrating an example of an abrasive machine using an abrasive sheet for forming line grooves on the surface of an electrophotographic photosensitive member.

FIG. 6 illustrates an example of an abrasive machine using an abrasive sheet for forming line grooves on the surface of an electrophotographic photosensitive member.

An example of the abrasive sheet is a sheet-shaped abrasive member obtained by forming, on a sheet-shaped base material, a layer having abrasive grains dispersed in a binder resin.

In FIG. 6, an abrasive sheet 601 is rolled on a hollow axis 606. A motor (not shown) is arranged so that a tension may be applied to the abrasive sheet 601 in a direction opposite to a direction in which the abrasive sheet 601 is fed by the axis 606. The abrasive sheet 601 is fed in the direction of an arrow in FIG. 6, and passes through a back-up roller 603 via guide rollers 602*a*, 602*b*. Then, the abrasive sheet 601 after abrading is taken up on a take-up unit 605 by means of a motor (not shown) via guide rollers 602*c*, 602*d*. Abrading is performed by bringing the abrasive sheet 601 constantly into pressure contact with an object to be processed (electrophotographic photosensitive member before the formation of the line grooves on its surface (peripheral surface)) 604 to roughen the surface (peripheral surface) of the object to be processed 604. The abrasive sheet 601 has insulating property in many cases, and hence for a site with which the abrasive sheet 601 is brought into contact, the grounded site or the site having conductivity is preferably used.

The object to be processed 604 is placed at a position opposed to the back-up roller 603 across the abrasive sheet 601. At this time, the back-up roller 603 is pressed from the base material side of the abrasive sheet 601 against the object to be processed 604 at a predetermined pressure for a predetermined period of time to roughen the surface (peripheral surface) of the object to be processed 604. The rotation direction of the object to be processed 604 may be identical to the direction in which the abrasive sheet 601 is fed, or may be an opposite direction (opposed) thereto. In addition, the rotation direction of the object to be processed 604 may be changed during the surface-roughening.

The widths and the like of the line grooves may be adjusted by controlling, for example, the feeding speed of the abrasive sheet 601, the pressure at which the back-up roller 603 is pressed, the particle diameter and shape of each of the abrasive grains, the grain size of each of the abrasive grains to be dispersed on the abrasive sheet, the film thickness of the binder resin of the abrasive sheet, and the thickness of the base material.

Examples of the abrasive grains include particles of aluminum oxide, chromium oxide, diamond, iron oxide, cerium oxide, corundum, silica stone, silicon nitride, boron nitride, molybdenum carbide, silicon carbide, tungsten carbide, titanium carbide, and silicon oxide.

Examples of the binder resin for dispersing the abrasive grains to be used for the abrasive sheet include a thermoplastic resin, a thermosetting resin, a reactive resin, an electron beam curable resin, a UV curable resin, a visible light curable resin, and an anti-mold resin.

Examples of the thermoplastic resin include a vinyl chloride resin, polyamide, polyester, polycarbonate, an amino resin, a styrene-butadiene copolymer, a urethane elastomer, and a polyamide-silicone resin.

Examples of the thermosetting resin include a phenol resin, a phenoxy resin, an epoxy resin, polyurethane, polyester, a silicone resin, a melamine resin, and an alkyd resin.

In addition, in the present invention, the surface-roughening step (abrading step) may be performed a plurality of times so that an electrophotographic photosensitive member having desired specific line grooves on its surface may be obtained. In that case, the following method may be adopted: an abrasive sheet having dispersed thereon abrasive grains each having a coarse grain size is used first, and then replaced with an abrasive sheet having dispersed thereon abrasive grains each having a fine grain size. Alternatively, the following method may be adopted: an abrasive sheet having dispersed thereon abrasive grains each having a fine grain size is used first, and then replaced with an abrasive sheet having dispersed thereon abrasive grains each having a coarse grain size. In addition, a method involving a plurality of times of abrading using abrasive sheets having comparable grain size numbers but different abrasive grains may be adopted.

Examples of the base material to be used for the abrasive sheet include polyester, polyolefin, a cellulose resin, polyvinyl, polycarbonate, polyimide, polyamide, polysulfone, and polyphenylsulfone.

<Construction of Electrophotographic Photosensitive Member>

The electrophotographic photosensitive member of the present invention includes a cylindrical support and a photosensitive layer formed on the support.

In the present invention, used as the support is a cylindrical one, and hence the electrophotographic photosensitive member has a cylindrical shape.

Examples of the photosensitive layer include: a single-layer photosensitive layer containing a charge transporting substance and a charge generating substance in the same layer; and a laminated (function-separated) photosensitive layer in which a charge generating layer containing a charge generating substance and a charge transporting layer containing a charge transporting substance are separated. From the viewpoint of electrophotographic characteristics, a laminated photosensitive layer is preferred. In addition, the charge generating layer may have a laminated construction, and the charge transporting layer may have a laminated construction.

The support is preferably the one exhibiting conductivity (conductive support). A material for the support is exemplified by: metals and alloys such as iron, copper, gold, silver, aluminum, zinc, titanium, lead, nickel, tin, antimony, indium, chromium, an aluminum alloy, and stainless steel. In addition, there may be used a support made of a metal or support made of a plastic having a coat of aluminum, an aluminum alloy, an indium oxide-tin oxide alloy, or the like formed through vacuum deposition. In addition, there may also be used a support obtained by impregnating a plastic or paper with conductive particles such as carbon black, tin oxide particles, titanium oxide particles, or silver particles, or a support made of a conductive binder resin.

The surface of the support may be subjected to cutting treatment, surface-roughening treatment, alumite treatment, or the like for the purpose of the suppression of an interference fringe due to the scattering of laser light.

A conductive layer may be formed between the support and an undercoat layer or photosensitive layer (charge generating layer or charge transporting layer) to be described later for the purposes of, for example, the suppression of an interference fringe due to the scattering of laser light, and the covering of a flaw of the support.

The conductive layer may be formed by: applying an application liquid for a conductive layer, which is obtained by subjecting carbon black, a conductive pigment, a resistance regulating pigment, or the like to dispersion treatment together with a binder resin, to form a coating film; and drying the coating film. In addition, a compound that undergoes curing polymerization through heating, UV irradiation, radiation irradiation, or the like may be added to the application liquid for a conductive layer.

The thickness of the conductive layer is preferably 0.2 μm or more and 40 μm or less, more preferably 1 μm or more and 35 μm or less, still more preferably 5 μm or more and 30 μm or less.

Examples of the binder resin to be used for the conductive layer include a vinyl-based polymer, polyvinyl alcohol, polyvinyl acetal, polycarbonate, polyester, polysulfone, polyphenylene oxide, polyurethane, a cellulose resin, a phenol resin, a melamine resin, a silicon resin, and an epoxy resin.

Examples of the conductive pigment and the resistance regulating pigment include particles of a metal or alloy such as aluminum, zinc, copper, chromium, nickel, silver, or stainless steel, and plastic particles each having the metal or alloy deposited from the vapor on its surface. In addition, there may be used particles of a metal oxide such as zinc oxide, titanium oxide, tin oxide, antimony oxide, indium oxide, bismuth oxide, indium oxide doped with tin, or tin oxide doped with antimony or tantalum. One kind thereof may be used alone, or two or more kinds thereof may be used in combination.

The undercoat layer (intermediate layer) having a barrier function or an adhesive function may be formed between the support or the conductive layer and the photosensitive layer (charge generating layer or charge transporting layer).

The undercoat layer may be formed by: applying an application liquid for an undercoat layer, which is obtained by dissolving a resin (binder resin) in a solvent, to form a coating film; and drying the coating film.

Examples of the resin to be used for the undercoat layer include polyvinyl alcohol, poly-N-vinylimidazole, polyethylene oxide, ethyl cellulose, an ethylene-acrylic acid copolymer, casein, polyamide, N-methoxymethylated 6-nylon, and copolymerized nylon.

The thickness of the undercoat layer is preferably 0.05 μm or more and 7 μm or less, more preferably 0.1 μm or more and 2 μm or less.

Examples of the charge generating substance to be used for the photosensitive layer include a pyrylium dye, a thiapyrylium dye, a phthalocyanine pigment, an anthanthrone pigment, a dibenzopyrenequinone pigment, a pyranthrone pigment, an azo pigment, an indigo pigment, a quinacridone pigment, an asymmetric quinocyanine pigment, and a quinocyanine pigment. One kind of those charge generating substances may be used alone, or two or more kinds thereof may be used in combination.

Examples of the charge transporting substance to be used for the photosensitive layer include a hydrazone compound, an N,N-dialkylaniline compound, a diphenylamine compound, a triphenylamine compound, a triphenylmethane compound, a pyrazoline compound, a styryl compound, and a stilbene compound.

When the photosensitive layer is the laminated photosensitive layer, the charge generating layer may be formed by: applying an application liquid for a charge generating layer, which is obtained by subjecting a charge generating substance to dispersion treatment together with a binder resin and a solvent, to form a coating film; and drying the coating film.

The mass ratio of the charge generating substance to the binder resin (charge generating substance/binder resin) preferably falls within the range of from 1/4 or more to 1/0.3 or less.

As a method for the dispersion treatment, there is given, for example, a method involving using a homogenizer, an ultrasonic disperser, a ball mill, a vibrating ball mill, a sand mill, an attritor, a roll mill, or the like.

The charge transporting layer may be formed by: applying an application liquid for a charge transporting layer, which is obtained by dissolving a charge transporting substance and a binder resin in a solvent, to form a coating film; and drying the coating film.

Examples of the binder resin to be used for each of the charge generating layer and the charge transporting layer include a vinyl-based polymer, polyvinyl alcohol, polyvinyl acetal, polycarbonate, polyester, polysulfone, polyphenylene oxide, polyurethane, a cellulose resin, a phenol resin, a melamine resin, a silicon resin, and an epoxy resin.

The thickness of the charge generating layer is preferably 5 μm or less, more preferably 0.1 μm or more and 2 μm or less.

The thickness of the charge transporting layer is preferably 5 μm or more and 50 μm or less, more preferably 10 μm or more and 35 μm or less.

In addition, from the viewpoint of improving the durability of the electrophotographic photosensitive member, the surface layer of the electrophotographic photosensitive member is preferably formed of a crosslinked organic polymer.

In the present invention, for example, the charge transporting layer on the charge generating layer may be formed of the crosslinked organic polymer to serve as the surface layer of the electrophotographic photosensitive member. In addition, the surface layer formed of the crosslinked organic polymer may be formed as a second charge transporting layer or protective layer on the charge transporting layer on the charge generating layer. In addition, the surface layer formed of the crosslinked organic polymer is preferably formed using a charge transporting substance or conductive particles, and a crosslink-polymerizable monomer/oligomer.

The above-mentioned charge transporting substances may each be used as the charge transporting substance. In addition, various conductive particles may be used as the conductive particles. Examples of the crosslink-polymerizable monomer/oligomer include a compound having a chain-reaction polymerizable functional group such as an acryloyloxy group or a styryl group and a compound having a step-reaction polymerizable functional group such as a hydroxy group, an alkoxysilyl group, or an isocyanate group.

In addition, from the viewpoint of compatibility between the strength and charge transporting ability of a film, it is more preferred to use a compound having, in the same molecule, both a charge transporting structure (preferably a hole transporting structure) and an acryloyloxy group.

As a method for crosslinking-curing, there is given, for example, a method involving using heat, ultraviolet light, or radiation.

The surface layer formed of the crosslinked organic polymer has a thickness of preferably 0.1 μm or more and 30 μm or less, more preferably 1 μm or more and 10 μm or less.

An additive may be added to each layer of the electrophotographic photosensitive member.

Examples of the additive include: antidegradants such as an antioxidant and a UV absorber; organic resin particles such as fluorine atom-containing resin particles and acrylic resin particles; and inorganic particles of silica, titania, and alumina.

<Constructions of Process Cartridge and Electrophotographic Apparatus>

Figure 7:
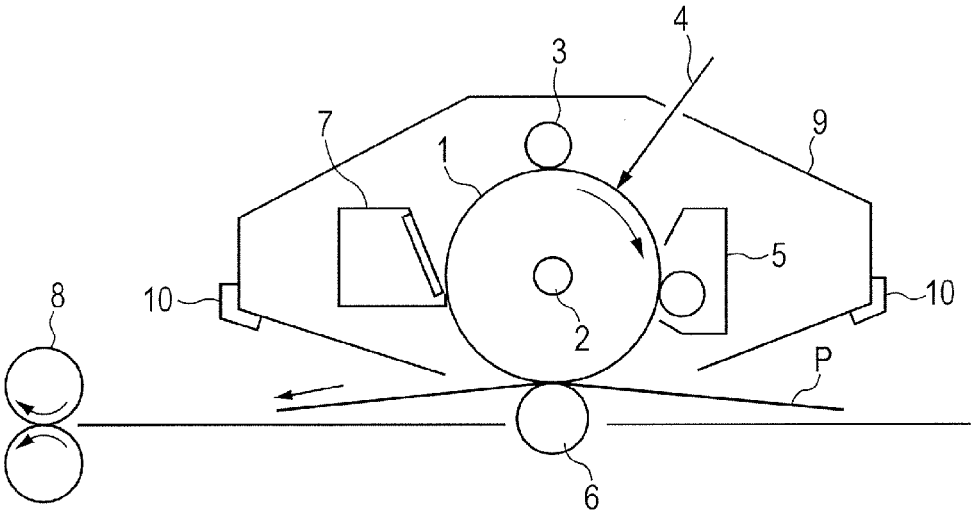
FIG. 7 is a diagram illustrating an example of an electrophotographic apparatus including a process cartridge including an electrophotographic photosensitive member of the present invention.

FIG. 7 illustrates an example of an electrophotographic apparatus including a process cartridge including the electrophotographic photosensitive member of the present invention.

In FIG. 7, a cylindrical electrophotographic photosensitive member 1 of the present invention is driven to rotate about an axis 2 in the direction of an arrow at a predetermined circumferential speed (process speed). The surface (peripheral surface) of the electrophotographic photosensitive member 1 is charged to a predetermined positive or negative potential by a charging unit 3 (primary charging unit: e.g., charging roller) during the process of rotation. Then, the charged surface (peripheral surface) of the electrophotographic photosensitive member 1 receives exposure light (image-exposure light) 4 radiated from an exposing unit (image-exposing unit) (not shown). Thus, an electrostatic latent image corresponding to image information of interest is formed on the surface (peripheral surface) of the electrophotographic photosensitive member 1.

The present invention provides a particularly great effect in the case of using a charging unit utilizing discharge.

The electrostatic latent image formed on the surface of the electrophotographic photosensitive member 1 is developed (normal development or reversal development) with toner in a developing unit 5 to form a toner image. The toner image formed on the surface of the electrophotographic photosensitive member 1 is transferred onto a transfer material P with a transfer bias from a transferring unit (such as a transfer roller) 6. At this time, the transfer material P is taken out and fed from a transfer material-supplying unit (not shown) to a space (abutting portion) between the electrophotographic photosensitive member 1 and the transferring unit 6 in synchronization with the rotation of the electrophotographic photosensitive member 1. In addition, a bias voltage opposite in polarity to charge held by the toner is applied to the transferring unit from a bias power source (not shown).

The transfer material P onto which the toner image has been transferred is separated from the surface (peripheral surface) of the electrophotographic photosensitive member and conveyed to a fixing unit 8, where the toner image is subjected to fixing treatment. Thus, the transfer material P is printed out as an image-formed product (print or copy) to the outside of the electrophotographic apparatus.

An adhered substance such as transfer residual toner is removed from the surface (peripheral surface) of the electrophotographic photosensitive member 1 after the transfer of the toner image by a cleaning unit 7 including a cleaning blade arranged so as to be brought into contact (to abut) with the surface (peripheral surface) of the electrophotographic photosensitive member 1. After that, the surface (peripheral surface) of the electrophotographic photosensitive member 1 is subjected to charge-eliminating treatment with pre-exposure light (not shown) from a pre-exposing unit (not shown), and then the electrophotographic photosensitive member 1 is repeatedly used in image formation. It should be noted that when the charging unit 3 is a contact charging unit using a charging roller or the like as illustrated in FIG. 7, the pre-exposing unit is not necessarily needed.

A plurality of constituent elements selected from the electrophotographic photosensitive member 1, the charging unit 3, the developing unit 5, the cleaning unit 7, and the like may be housed in a container and integrally supported as a process cartridge. In addition, the process cartridge may be removably mounted onto the main body of an electrophotographic apparatus such as a copying machine or a laser beam printer. In FIG. 7, the electrophotographic photosensitive member 1, the charging unit 3, the developing unit 5, and the cleaning unit 7 are integrally supported to form a cartridge. In addition, the cartridge is provided as a process cartridge 9 that is removably mounted onto the main body of an electrophotographic apparatus through the use of a guiding unit 10 such as the rail of the main body of the electrophotographic apparatus.

When the electrophotographic apparatus is a copying machine, the exposure light 4 is: reflected light or transmitted light from an original; or light to be applied by, for example, scanning with a laser beam or driving of an LED array or a liquid crystal shutter array to be performed according to a signal obtained by signalizing the original read with a sensor.

The present invention is hereinafter described in more detail by way of specific examples. It should be noted that the term "part(s)" in the examples refers to "part(s) by mass". In addition, the electrophotographic photosensitive member is hereinafter sometimes referred to simply as "photosensitive member". In addition, in all of the following examples, the openings of depressed portions formed on the surfaces of electrophotographic photosensitive members each have such a circular shape that the longest diameter of the opening and the shortest diameter of the opening are equal to each other.

(Production Example of Photosensitive Member-1)

An aluminum cylinder having a diameter of 30 mm and a length of 357.5 mm was used as a support (cylindrical support).

Next, 100 parts of zinc oxide particles (specific surface area: 19 $m^2/g$, powder resistivity: $4.7\times10^6$ Ω·cm) as a metal oxide were mixed with 500 parts of toluene by stirring, and 0.8 part of a silane coupling agent was added to the mixture, followed by stirring for 6 hours. After that, toluene was removed by evaporation under reduced pressure and the residue was dried by heating at 130° C. for 6 hours to provide surface-treated zinc oxide particles. N-2-(aminoethyl)-3-aminopropylmethyldimethoxysilane (trade name: KBM602, manufactured by Shin-Etsu Chemical Co., Ltd.) was used as the silane coupling agent.

Next, 15 parts of a butyral resin (trade name: BM-1, manufactured by SEKISUI CHEMICAL CO., LTD.) as polyol and 15 parts of a blocked isocyanate (trade name: Sumidur 3175, manufactured by Sumika Bayer Urethane Co., Ltd.) were dissolved in a mixed solvent of 73.5 parts of methyl ethyl ketone and 73.5 parts of 1-butanol. 80.8 Parts of the surface-treated zinc oxide particles and 0.8 part of 2,3,4-trihydroxybenzophenone (manufactured by Tokyo Chemical Industry Co., Ltd.) were added to the resultant solution, and the mixture was subjected to dispersion treatment with a sand mill apparatus using glass beads each having a diameter of 0.8 mm under an atmosphere having a temperature of 23±3° C. for 3 hours. After the dispersion treatment, 0.01 part of silicone oil (trade name: SH28PA, manufactured by Dow Corning Toray Co., Ltd.) and 5.6 parts of crosslinked polymethyl methacrylate (PMMA) particles (trade name: TECHPOLYMER SSX-102, manufactured by SEKISUI PLASTICS CO., Ltd., average primary particle diameter: 2.5 μm) were added to the resultant, and the mixture was stirred to prepare an application liquid for an undercoat layer.

The application liquid for an undercoat layer was applied onto the support by dipping to form a coating film, and the coating film was dried for 40 minutes at 160° C. to form an undercoat layer having a thickness of 18 μm.

Next, 20 parts of a hydroxygallium phthalocyanine crystal (charge generating substance) of a crystal form having peaks at Bragg angles 2θ±0.2° in CuKα characteristic X-ray diffraction of 7.4° and 28.2°, 0.2 part of a calixarene compound represented by the following formula (A), (A)

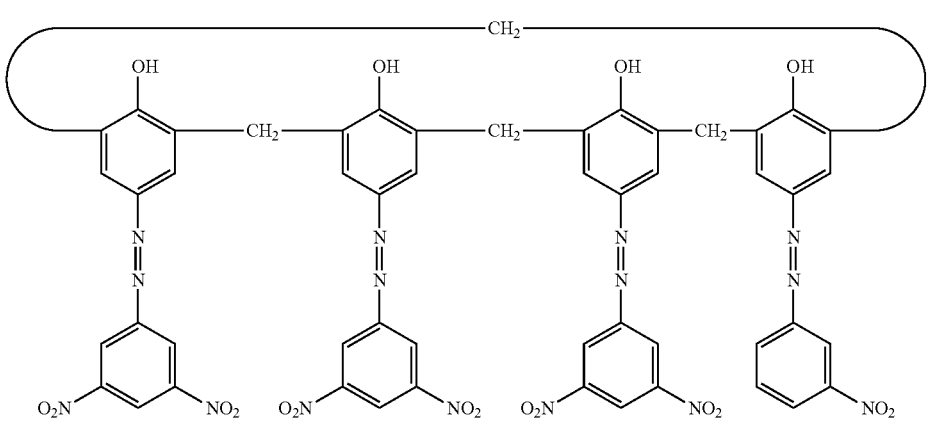

10 parts of polyvinyl butyral (trade name: S-LEC BX-1, manufactured by SEKISUI CHEMICAL CO., LTD.), and 600 parts of cyclohexanone were loaded into a sand mill using glass beads each having a diameter of 1 mm, followed by dispersion treatment for 4 hours. After the dispersion treatment, 700 parts of ethyl acetate were further added to the resultant to prepare an application liquid for a charge generating layer. The application liquid for a charge generating layer was applied onto the undercoat layer by dipping to form a coating film, and the coating film was dried for 15 minutes at 80° C. to form a charge generating layer having a thickness of 0.17 μm.

Next, 30 parts of a compound represented by the following formula (B) (charge transporting substance), 60 parts of a compound represented by the following formula (C) (charge transporting substance), 10 parts of a compound represented by the following formula (D), (B)

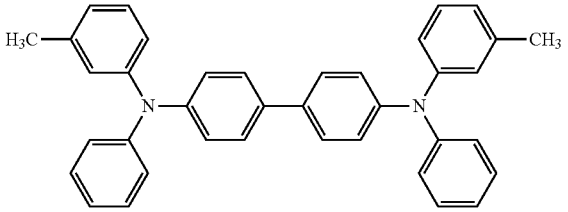

(C)

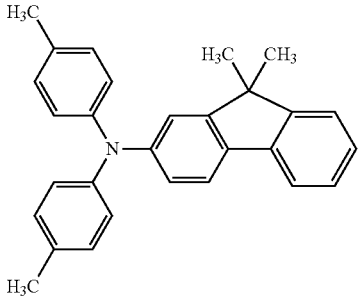

-continued (D)

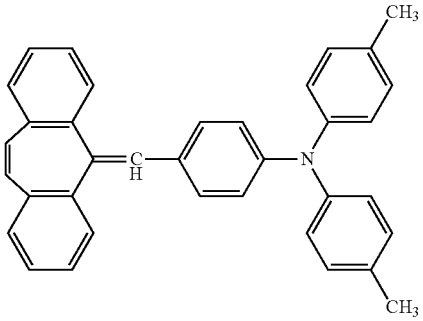

100 parts of polycarbonate (trade name: Iupilon Z400, manufactured by Mitsubishi Engineering-Plastics Corporation, bisphenol Z-type polycarbonate), and 0.02 part of polycarbonate having structural units represented by the following formula (E) (viscosity-average molecular weight Mv: 20,000)

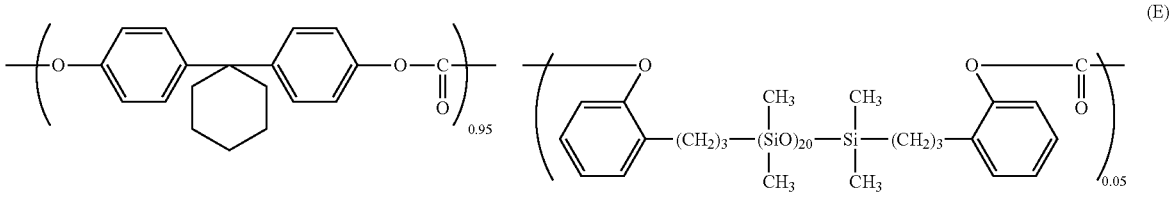

(in the formula (E), 0.95 and 0.05 represent the molar ratios (copolymerization ratios) of two structural units) were dissolved in a mixed solvent of 600 parts of xylene and 200 parts of dimethoxymethane to prepare an application liquid for a charge transporting layer. The application liquid for a charge transporting layer was applied onto the charge generating layer by dipping to form a coating film, and the coating film was dried for 30 minutes at 100° C. to form a charge transporting layer having a thickness of 18 μm.

Next, a mixed solvent of 20 parts of 1,1,2,2,3,3,4-heptafluorocyclopentane (trade name: ZEORORA H, manufactured by Zeon Corporation) and 20 parts of 1-propanol was filtered through a polyflon filter (trade name: PF-040, manufactured by Advantec Toyo Kaisha, Ltd.). After that, 90 parts of a hole transporting compound represented by the following formula (F),

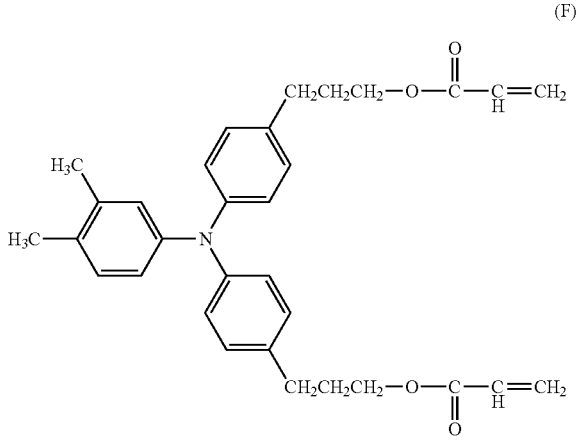

70 parts of 1,1,2,2,3,3,4-heptafluorocyclopentane, and 70 parts of 1-propanol were added to the above-mentioned mixed solvent. The mixture was filtered through a polyflon filter (trade name: PF-020, manufactured by Advantec Toyo Kaisha, Ltd.) to prepare an application liquid for a second charge transporting layer (protective layer). The application liquid for a second charge transporting layer was applied onto the above-mentioned charge transporting layer by dipping to form a coating film, and the coating film was dried in the air for 6 minutes at 50° C. After that, in nitrogen, while the support (body to be irradiated) was rotated at 200 rpm, the coating film was irradiated with an electron beam under the conditions of an accelerating voltage of 70 kV and an absorbed dose of 8,000 Gy for 1.6 seconds. Subsequently, the coating film was heated in nitrogen by increasing the temperature from 25° C. to 125° C. in 30 seconds. The atmosphere at the time of each of the electron beam irradiation and the subsequent heating had an oxygen concentration of 15 ppm. Next, heating treatment was performed in the air for 30 minutes at 100° C. to form an electron beam-cured second charge transporting layer (protective layer) having a thickness of 5 μm.

Thus, a cylindrical electrophotographic photosensitive member before the formation of depressed portions and line grooves on its surface (hereinafter sometimes referred to as "electrophotographic photosensitive member before depressed portion/line groove formation") was produced.

Next, as described below, the surface (peripheral surface) of the electrophotographic photosensitive member was processed in the order of the formation of depressed portions and the formation of line grooves.

Figure 8A:
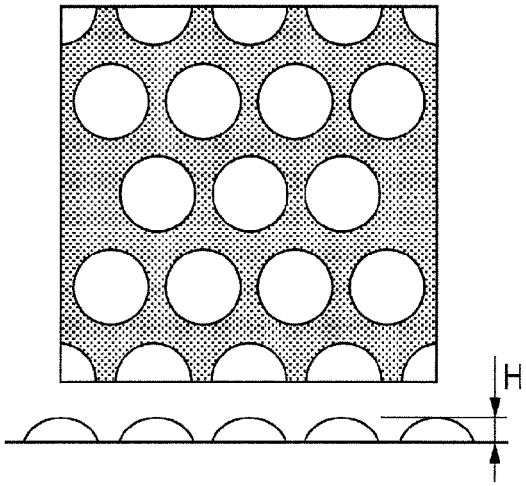
FIG. 8A, FIG. 8B, and FIG. 8C are diagrams illustrating molds used in production examples of electrophotographic photosensitive members.

Formation of Depressed Portions Using Pressure-Contact Shape Transfer Processing Apparatus A pressure-contact shape transfer processing apparatus having a construction substantially as illustrated in FIG. 5 was mounted with a mold having a shape substantially as illustrated in FIG. 8A (longest diameter (referring to a longest diameter in the case where protruded portions on the mold are viewed from above; the same applies hereinafter) Xmax: 41 μm, shortest diameter (referring to a shortest diameter in the case where the protruded portions on the mold are viewed from above; the same applies hereinafter) Xmin: 41 μm, area ratio: 50%, height H: 3 μm, shape: domed shape) as a mold. Then, the produced electrophotographic photosensitive member before depressed portion/line groove formation was subjected to surface processing. At the time of the surface processing, the temperatures of the electrophotographic photosensitive member and the mold were controlled so that the surface of the electrophotographic photosensitive member had a temperature of 120° C. In addition, while the electrophotographic photosensitive member and the pressurizing member were pressed at a pressure of 7.0 MPa, the electrophotographic photosensitive member was rotated in its circumferential direction to form depressed portions on the entire surface (peripheral surface) of the electrophotographic photosensitive member.

Formation of Line Grooves

An abrasive sheet (GC3000) manufactured by RIKEN CORUNDUM CO., LTD. was used. The feeding speed of the abrasive sheet was set to 40 mm/min, the number of rotations of an object to be processed (electrophotographic photosensitive member having depressed portions formed on its entire surface) was set to 240 rpm, and the pressure at which the abrasive sheet was pressed against the object to be processed was set to 7.5 $N/m^2$. The feeding direction of the abrasive sheet and the rotation direction of the object to be processed were set to be the same direction (hereinafter sometimes referred to as "With"; the opposite direction is sometimes referred to as "Counter"). In addition, a back-up roller having an outer diameter of 40 cm and an Asker C hardness of 40 was used. Under those conditions, line grooves were formed on the peripheral surface of the object to be processed in 10 seconds.

Thus, an electrophotographic photosensitive member having depressed portions and line grooves on its surface (peripheral surface) was produced. This electrophotographic photosensitive member is defined as "photosensitive member-1".

Observation of Surface of Electrophotographic Photosensitive Member

The surface of the resultant electrophotographic photosensitive member (photosensitive member-1) was observed with a laser microscope (manufactured by KEYENCE CORPORATION, trade name: X-100) under magnification with a 50× lens, and determinations were made on the specific depressed portions and specific line grooves formed on the surface of the electrophotographic photosensitive member as described above. At the time of the observation, adjustment was performed so that: there was no slope in the longitudinal direction of the electrophotographic photosensitive member; and regarding its circumferential direction, the apex of the arc of the electrophotographic photosensitive member was brought into focus. A square region 500 μm on a side was obtained by combining images obtained by the observation under magnification with an image combining application. In addition, regarding the obtained results, using accompanying image analysis software, image processing height data was selected, and filter processing was performed by a filter type median.

Through the observation, for example, the following were determined: the depth, longest diameter of an opening and shortest diameter of the opening, and area of the specific depressed portions, and the width in the generatrix line direction of the electrophotographic photosensitive member, length in the circumferential direction of the electrophotographic photosensitive member, angle with respect to the generatrix line direction of the electrophotographic photosensitive member, and number of the line grooves. Table 1 shows the results. The line grooves formed at portions other than the depressed portions had a depth of 0.03 μm on average.

It should be noted that the surface (peripheral surface) of the electrophotographic photosensitive member (photosensitive member-1) was observed using another laser microscope (manufactured by KEYENCE CORPORATION, trade name: X-9500) by a method similar to the above. In this case, similar results to those in the case of using the above-mentioned laser microscope (manufactured by KEYENCE CORPORATION, trade name: X-100) were obtained.

In view of this, in the following production examples, the laser microscope (manufactured by KEYENCE CORPORATION, trade name: X-100) and the 50× lens were used in the observation of the surfaces (peripheral surfaces) of electrophotographic photosensitive members (photosensitive member-2 to photosensitive member-75 and photosensitive member-101 to photosensitive member-110).

(Production Example of Photosensitive Member-2)

In the production example of the photosensitive member-1, the mold and the abrading treatment time were changed as shown in Table 1. An electrophotographic photosensitive member was produced in the same manner as in the production example of the photosensitive member-1 except for these conditions. This electrophotographic photosensitive member is defined as "photosensitive member-2". The surface of the resultant electrophotographic photosensitive member was observed in the same manner as in the production example of the photosensitive member-1. Table 1 shows the results. The line grooves formed at portions other than the depressed portions had a depth of 0.03 μm on average.

(Production Examples of Photosensitive Member-3 to Photosensitive Member-8)

In the production example of the photosensitive member-1, the mold and the abrading treatment time were changed as shown in Table 1. Electrophotographic photosensitive members were produced in the same manner as in the production example of the photosensitive member-1 except for these conditions. The line grooves formed at portions of the surface of each of the electrophotographic photosensitive members other than the depressed portions had a depth of 0.03 μm on average. These electrophotographic photosensitive members are defined as "photosensitive member-3 to photosensitive member-8". The surface of each of the resultant electrophotographic photosensitive members was observed in the same manner as in the production example of the photosensitive member-1. Table 1 shows the results.

(Production Examples of Photosensitive Member-9 to Photosensitive Member-11)

In the production example of the photosensitive member-1, the mold and the abrading treatment time were changed as shown in Table 1, and an abrasive sheet (GC6000) manufactured by RIKEN CORUNDUM CO., LTD. was used in place of the abrasive sheet (GC3000). Electrophotographic photosensitive members were produced in the same manner as in the production example of the photosensitive member-1 except for these conditions. The line grooves formed at portions of the surface of each of the electrophotographic photosensitive members other than the depressed portions had a depth of 0.01 μm on average. These electrophotographic photosensitive members are defined as "photosensitive member-9 to photosensitive member-11". The surface of each of the resultant electrophotographic photosensitive members was observed in the same manner as in the production example of the photosensitive member-1. Table 1 shows the results.

(Production Examples of Photosensitive Member-12 to Photosensitive Member-17)

In the production example of the photosensitive member-1, the mold and the abrading treatment time were changed as shown in Table 1. Electrophotographic photosensitive members were produced in the same manner as in the production example of the photosensitive member-1 except for these conditions. The line grooves formed at portions of the surface of each of the electrophotographic photosensitive members other than the depressed portions had a depth of 0.03 μm on average. These electrophotographic photosensitive members are defined as "photosensitive member-12 to photosensitive member-17". The surface of each of the resultant electrophotographic photosensitive members was observed in the same manner as in the production example of the photosensitive member-1. Table 1 shows the results.

(Production Examples of Photosensitive Member-18 to Photosensitive Member-23)

In the production example of the photosensitive member-1, the mold and the abrading treatment time were changed as shown in Table 1, and an abrasive sheet (GC6000) manufactured by RIKEN CORUNDUM CO., LTD. was used in place of the abrasive sheet (GC3000). Electrophotographic photosensitive members were produced in the same manner as in the production example of the photosensitive member-1 except for these conditions. The line grooves formed at portions of the surface of each of the electrophotographic photosensitive members other than the depressed portions had a depth of 0.01 μm on average. These electrophotographic photosensitive members are defined as "photosensitive member-18 to photosensitive member-23". The surface of each of the resultant electrophotographic photosensitive members was observed in the same manner as in the production example of the photosensitive member-1. Table 1 shows the results.

(Production Examples of Photosensitive Member-24 to Photosensitive Member-41)

In the production example of the photosensitive member-1, the mold and the abrading treatment time were changed as shown in Table 1. Electrophotographic photosensitive members were produced in the same manner as in the production example of the photosensitive member-1 except for these conditions. These electrophotographic photosensitive members are defined as "photosensitive member-24 to photosensitive member-41". The line grooves formed at portions of the surface of each of the electrophotographic photosensitive members other than the depressed portions had a depth of 0.03 μm on average. The surface of each of the resultant electrophotographic photosensitive members was observed in the same manner as in the production example of the photosensitive member-1. Table 1 shows the results.

(Production Examples of Photosensitive Member-42 to Photosensitive Member-47)

In the production example of the photosensitive member-1, the mold and the abrading treatment time were changed as shown in Table 1, and an abrasive sheet (GC6000) manufactured by RIKEN CORUNDUM CO., LTD. was used in place of the abrasive sheet (GC3000). Electrophotographic photosensitive members were produced in the same manner as in the production example of the photosensitive member-1 except for these conditions. These electrophotographic photosensitive members are defined as "photosensitive member-42 to photosensitive member-47". The line grooves formed at portions of the surface of each of the photosensitive member-42 to the photosensitive member-44 other than the depressed portions had a depth of 0.15 μm on average, and the line grooves formed at portions of the surface of each of the photosensitive member-45 to the photosensitive member-47 other than the depressed portions had a depth of 0.02 μm on average. The surface of each of the resultant electrophotographic photosensitive members was observed in the same manner as in the production example of the photosensitive member-1. Table 1 shows the results.

(Production Examples of Photosensitive Member-48 to Photosensitive Member-71)

In the production example of the photosensitive member-1, the mold and the abrading treatment time were changed as shown in Table 1. Electrophotographic photosensitive members were produced in the same manner as in the production example of the photosensitive member-1 except for these conditions. The line grooves formed at portions of the surface of each of the electrophotographic photosensitive members other than the depressed portions had a depth of 0.03 μm on average. These electrophotographic photosensitive members are defined as "photosensitive member-48 to photosensitive member-71". The surface of each of the resultant electrophotographic photosensitive members was observed in the same manner as in the production example of the photosensitive member-1. Table 1 shows the results.

(Production Examples of Photosensitive Member-72 and Photosensitive Member-73)

An undercoat layer, a charge generating layer, and a charge transporting layer were formed on a support in the same manner as in the production example of the photosensitive member-1.

Next, 100 parts of the compound represented by the formula (F), 3.5 parts of a siloxane-modified acrylic compound (BYK-3550, manufactured by BYK Japan KK), and 300 parts of 1-propanol were mixed and stirred. The siloxane-modified acrylic compound was easily dissolved. The solution was filtered through a polyflon filter (trade name: PF-020, manufactured by Advantec Toyo Kaisha, Ltd.) to prepare an application liquid for a surface layer.

The application liquid for a surface layer was applied onto the charge transporting layer by dipping to form a coating film, and the coating film was dried in the air for 10 minutes at 50° C. After that, under a nitrogen atmosphere, while the support (body to be irradiated) was rotated at 200 rpm, the coating film was irradiated with an electron beam under the conditions of an accelerating voltage of 150 kV and a beam current of 3.0 mA for 1.6 seconds. It should be noted that the absorbed dose of the electron beam at this time was measured and found to be 15 kGy. Subsequently, the coating film was heated under a nitrogen atmosphere by increasing the temperature of the coating film from 25° C. to 125° C. in 30 seconds. The atmosphere during the electron beam irradiation and the subsequent heating treatment had an oxygen concentration of ppm or less. Next, the coating film was naturally cooled to 25° C. in the air, and the coating film was subjected to heating treatment for 30 minutes under such a condition that its temperature became 100° C. in the air to form a surface layer having a thickness of 5 μm.

Thus, a cylindrical electrophotographic photosensitive member before the formation of depressed portions and line grooves on its surface (electrophotographic photosensitive member before depressed portion/line groove formation) was produced.

After that, the mold and the abrading treatment time were changed as shown in Table 1. Electrophotographic photosensitive members were produced in the same manner as in the production example of the photosensitive member-1 except for these conditions. The line grooves formed at portions of the surface of each of the electrophotographic photosensitive members other than the depressed portions had a depth of 0.05 μm on average. These electrophotographic photosensitive members are defined as "photosensitive member-72 and photosensitive member-73". The surface of each of the resultant electrophotographic photosensitive members was observed in the same manner as in the production example of the photosensitive member-1. Table 1 shows the results.

(Production Example of Photosensitive Member-74)

A cylindrical electrophotographic photosensitive member before the formation of depressed portions and line grooves on its surface (electrophotographic photosensitive member before depressed portion/line groove formation) was produced in the same manner as in the production example of the photosensitive member-1.

Figure 8B:
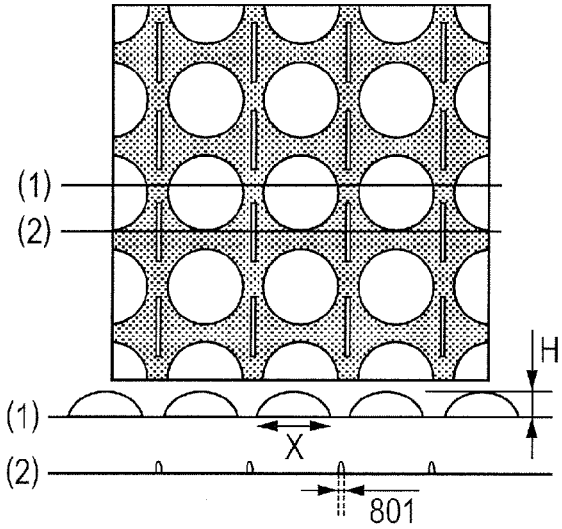

Next, a mold having a shape substantially as illustrated in FIG. 8B was used and a shape corresponding to the shape of the mold was formed on the entire surface (peripheral surface) of the electrophotographic photosensitive member by a method similar to that for the photosensitive member-1. In FIG. 8B, the longest diameter Xmax is 50 μm, the shortest diameter Xmin is 50 μm, the area ratio is 50%, the height H is 3 μm, and the shape is a domed shape. The line groove has a width 801. The line grooves formed at portions of the surface of the electrophotographic photosensitive member other than the depressed portions had a depth of 0.03 μm on average. This electrophotographic photosensitive member is defined as "photosensitive member-74". The surface of the resultant electrophotographic photosensitive member was observed in the same manner as in the production example of the photosensitive member-1. Table 1 shows the results.

(Production Example of Photosensitive Member-75)

A cylindrical electrophotographic photosensitive member before the formation of depressed portions and line grooves on its surface (electrophotographic photosensitive member before depressed portion/line groove formation) was produced in the same manner as in the production example of the photosensitive member-1.

Figure 8C:
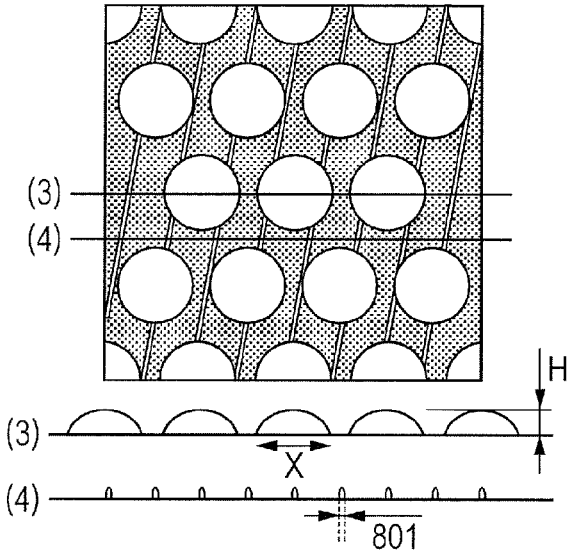

Next, a mold having a shape substantially as illustrated in FIG. 8C was used and a shape corresponding to the shape of the mold was formed on the entire surface (peripheral surface) of the electrophotographic photosensitive member by a method similar to that for the photosensitive member-1. In FIG. 8C, the longest diameter Xmax is 50 μm, the shortest diameter Xmin is 50 μm, the area ratio is 50%, the height H is 3 μm, and the shape is a domed shape. The line groove has a width 801. The line grooves formed at portions of the surface of the electrophotographic photosensitive member other than the depressed portions had a depth of 0.03 μm on average. This electrophotographic photosensitive member is defined as "photosensitive member-75". The surface of the resultant electrophotographic photosensitive member was observed in the same manner as in the production example of the photosensitive member-1. Table 1 shows the results.

TABLE 1

| | Mold | | | | Surface of electrophotographic photosensitive member | | | | | | | | | Abrading treatment |
|---|---|---|---|---|---|---|---|---|---|---|---|---|---|---|
| | Longest diameter [μm] | Shortest diameter [μm] | Area ratio [%] | Height (H) [μm] | Longest diameter of opening (Xmax) [μm] | Shortest diameter of opening (Xmin) [μm] | Area of opening [$\mu m^2$] | Depth of depressed portion (Z) [μm] | Standard deviation | Maximum width of line groove [μm] | Minimum width of line groove [μm] | Number of grooves each having width of 1 μm or more and 10 μm or less and length of 30 μm or more | Angle of line groove | Treatment time [s] |
| Photosensitive member-1 | 41 | 41 | 50 | 3 | 40 | 40 | 125,000 | 2 | 1 | 9 | 0.5 | 123 | 0 | 10 |
| Photosensitive member-2 | 52 | 52 | 50 | 3 | 50 | 50 | 125,000 | 2 | 1 | 9 | 0.5 | 130 | 0 | 11 |
| Photosensitive member-3 | 20 | 20 | 38 | 1 | 20 | 20 | 95,000 | 0.5 | 1 | 18 | 0.5 | 28 | 0 | 16 |
| Photosensitive member-4 | 20 | 20 | 38 | 4 | 20 | 20 | 95,000 | 3 | 1 | 21 | 0.5 | 41 | 0 | 16 |
| Photosensitive member-5 | 20 | 20 | 38 | 6 | 20 | 20 | 95,000 | 5 | 1 | 16 | 0.5 | 38 | 0 | 16 |
| Photosensitive member-6 | 20 | 20 | 38 | 1 | 20 | 20 | 95,000 | 0.5 | 1 | 8 | 0.5 | 115 | 0 | 11 |
| Photosensitive member-7 | 20 | 20 | 38 | 4 | 20 | 20 | 95,000 | 3 | 1 | 9 | 0.5 | 125 | 0 | 11 |
| Photosensitive member-8 | 20 | 20 | 38 | 6 | 20 | 20 | 95,000 | 5 | 1 | 10 | 0.5 | 132 | 0 | 11 |
| Photosensitive member-9 | 20 | 20 | 72 | 1 | 20 | 20 | 180,000 | 0.5 | 1 | 5 | 0.5 | 20 | 0 | 5 |
| Photosensitive member-10 | 20 | 20 | 72 | 4 | 20 | 20 | 180,000 | 3 | 1 | 4 | 0.5 | 19 | 0 | 5 |
| Photosensitive member-11 | 20 | 20 | 72 | 6 | 20 | 20 | 180,000 | 5 | 1 | 3 | 0.5 | 33 | 0 | 5 |
| Photosensitive member-12 | 80 | 80 | 38 | 1 | 80 | 80 | 95,000 | 0.5 | 1 | 20 | 0.5 | 48 | 0 | 16 |
| Photosensitive member-13 | 80 | 80 | 38 | 4 | 80 | 80 | 95,000 | 3 | 1 | 21 | 0.5 | 41 | 0 | 16 |
| Photosensitive member-14 | 80 | 80 | 38 | 6 | 80 | 80 | 95,000 | 5 | 1 | 19 | 0.5 | 44 | 0 | 16 |
| Photosensitive member-15 | 80 | 80 | 38 | 1 | 80 | 80 | 95,000 | 0.5 | 1 | 9 | 0.5 | 71 | 0 | 11 |
| Photosensitive member-16 | 80 | 80 | 38 | 4 | 80 | 80 | 95,000 | 3 | 1 | 10 | 0.5 | 62 | 0 | 11 |
| Photosensitive member-17 | 80 | 80 | 38 | 6 | 80 | 80 | 95,000 | 5 | 1 | 8 | 0.5 | 55 | 0 | 11 |
| Photosensitive member-18 | 80 | 80 | 72 | 1 | 80 | 80 | 180,000 | 0.5 | 1 | 4 | 0.5 | 19 | 0 | 5 |
| Photosensitive member-19 | 80 | 80 | 72 | 4 | 80 | 80 | 180,000 | 3 | 1 | 4 | 0.5 | 25 | 0 | 5 |
| Photosensitive member-20 | 80 | 80 | 72 | 6 | 80 | 80 | 180,000 | 5 | 1 | 5 | 0.5 | 20 | 0 | 5 |
| Photosensitive member-21 | 80 | 80 | 72 | 1 | 80 | 80 | 180,000 | 0.5 | 1 | 6 | 0.5 | 62 | 0 | 10 |

TABLE 1-continued

| | Mold | | | | Surface of electrophotographic photosensitive member | | | | | | | | | Abrading treatment |
|---|---|---|---|---|---|---|---|---|---|---|---|---|---|---|
| | Longest diameter [μm] | Shortest diameter [μm] | Area ratio [%] | Height (H) [μm] | Longest diameter of opening (Xmax) [μm] | Shortest diameter of opening (Xmin) [μm] | Area of opening [$\mu m^2$] | Depth of depressed portion (Z) [μm] | Standard deviation | Maximum width of line groove [μm] | Minimum width of line groove [μm] | Number of grooves each having width of 1 μm or more and 10 μm or less and length of 30 μm or more | Angle of line groove | Treatment time [s] |
| Photosensitive member-22 | 80 | 80 | 72 | 4 | 80 | 80 | 180,000 | 3 | 1 | 4 | 0.5 | 68 | 0 | 10 |
| Photosensitive member-23 | 80 | 80 | 72 | 6 | 80 | 80 | 180,000 | 5 | 1 | 5 | 0.5 | 52 | 0 | 10 |
| Photosensitive member-24 | 30 | 30 | 38 | 1 | 30 | 30 | 95,000 | 0.5 | 1 | 23 | 0.5 | 45 | 0 | 16 |
| Photosensitive member-25 | 30 | 30 | 38 | 4 | 30 | 30 | 95,000 | 3 | 1 | 25 | 0.5 | 42 | 0 | 16 |
| Photosensitive member-26 | 30 | 30 | 38 | 6 | 30 | 30 | 95,000 | 5 | 1 | 20 | 0.5 | 45 | 0 | 16 |
| Photosensitive member-27 | 30 | 30 | 38 | 1 | 30 | 30 | 95,000 | 0.5 | 1 | 10 | 0.5 | 110 | 0 | 11 |
| Photosensitive member-28 | 30 | 30 | 38 | 4 | 30 | 30 | 95,000 | 3 | 1 | 8 | 0.5 | 139 | 0 | 11 |
| Photosensitive member-29 | 30 | 30 | 38 | 6 | 30 | 30 | 95,000 | 5 | 1 | 8 | 0.5 | 122 | 0 | 11 |
| Photosensitive member-30 | 30 | 30 | 40 | 1 | 30 | 30 | 100,000 | 0.5 | 1 | 21 | 0.5 | 39 | 0 | 16 |
| Photosensitive member-31 | 30 | 30 | 40 | 4 | 30 | 30 | 100,000 | 3 | 1 | 19 | 0.5 | 33 | 0 | 16 |
| Photosensitive member-32 | 30 | 30 | 40 | 6 | 30 | 30 | 100,000 | 5 | 1 | 17 | 0.5 | 46 | 0 | 16 |
| Photosensitive member-33 | 30 | 30 | 40 | 1 | 30 | 30 | 100,000 | 0.5 | 1 | 8 | 0.5 | 101 | 0 | 11 |
| Photosensitive member-34 | 30 | 30 | 40 | 4 | 30 | 30 | 100,000 | 3 | 1 | 9 | 0.5 | 109 | 0 | 11 |
| Photosensitive member-35 | 30 | 30 | 40 | 6 | 30 | 30 | 100,000 | 5 | 1 | 9 | 0.5 | 118 | 0 | 11 |
| Photosensitive member-36 | 30 | 30 | 64 | 1 | 30 | 30 | 160,000 | 0.5 | 1 | 17 | 0.5 | 49 | 0 | 16 |
| Photosensitive member-37 | 30 | 30 | 64 | 4 | 30 | 30 | 160,000 | 3 | 1 | 17 | 0.5 | 43 | 0 | 16 |
| Photosensitive member-38 | 30 | 30 | 64 | 6 | 30 | 30 | 160,000 | 5 | 1 | 15 | 0.5 | 45 | 0 | 16 |
| Photosensitive member-39 | 30 | 30 | 64 | 1 | 30 | 30 | 160,000 | 0.5 | 1 | 6 | 0.5 | 72 | 0 | 11 |
| Photosensitive member-40 | 30 | 30 | 64 | 4 | 30 | 30 | 160,000 | 3 | 1 | 8 | 0.5 | 64 | 0 | 11 |
| Photosensitive member-41 | 30 | 30 | 64 | 6 | 30 | 30 | 160,000 | 5 | 1 | 7 | 0.5 | 83 | 0 | 11 |
| Photosensitive member-42 | 30 | 30 | 72 | 1 | 30 | 30 | 180,000 | 0.5 | 1 | 20 | 0.5 | 23 | 0 | 5 |
| Photosensitive member-43 | 30 | 30 | 72 | 4 | 30 | 30 | 180,000 | 3 | 1 | 20 | 0.5 | 21 | 0 | 5 |

TABLE 1-continued

| | Mold | | | | Surface of electrophotographic photosensitive member | | | | | | | | | Abrading treatment |
|---|---|---|---|---|---|---|---|---|---|---|---|---|---|---|
| | Longest diameter [μm] | Shortest diameter [μm] | Area ratio [%] | Height (H) [μm] | Longest diameter of opening (Xmax) [μm] | Shortest diameter of opening (Xmin) [μm] | Area of opening [$\mu m^2$] | Depth of depressed portion (Z) [μm] | Standard deviation | Maximum width of line groove [μm] | Minimum width of line groove [μm] | Number of grooves each having width of 1 μm or more and 10 μm or less and length of 30 μm or more | Angle of line groove | Treatment time [s] |
| Photosensitive member-44 | 30 | 30 | 72 | 6 | 30 | 30 | 180,000 | 5 | 1 | 16 | 0.5 | 19 | 0 | 5 |
| Photosensitive member-45 | 30 | 30 | 72 | 1 | 30 | 30 | 180,000 | 0.5 | 1 | 4 | 0.5 | 52 | 0 | 12 |
| Photosensitive member-46 | 30 | 30 | 72 | 4 | 30 | 30 | 180,000 | 3 | 1 | 3 | 0.5 | 51 | 0 | 12 |
| Photosensitive member-47 | 30 | 30 | 72 | 6 | 30 | 30 | 180,000 | 5 | 1 | 3 | 0.5 | 50 | 0 | 12 |
| Photosensitive member-48 | 60 | 60 | 38 | 1 | 60 | 60 | 95,000 | 0.5 | 1 | 17 | 0.5 | 45 | 0 | 16 |
| Photosensitive member-49 | 60 | 60 | 38 | 4 | 60 | 60 | 95,000 | 3 | 1 | 20 | 0.5 | 41 | 0 | 16 |
| Photosensitive member-50 | 60 | 60 | 38 | 6 | 60 | 60 | 95,000 | 5 | 1 | 16 | 0.5 | 40 | 0 | 16 |
| Photosensitive member-51 | 60 | 60 | 38 | 1 | 60 | 60 | 95,000 | 0.5 | 1 | 9 | 0.5 | 122 | 0 | 11 |
| Photosensitive member-52 | 60 | 60 | 38 | 4 | 60 | 60 | 95,000 | 3 | 1 | 9 | 0.5 | 130 | 0 | 11 |
| Photosensitive member-53 | 60 | 60 | 38 | 6 | 60 | 60 | 95,000 | 5 | 1 | 6 | 0.5 | 135 | 0 | 11 |
| Photosensitive member-54 | 60 | 60 | 40 | 1 | 60 | 60 | 100,000 | 0.5 | 1 | 23 | 0.5 | 39 | 0 | 16 |
| Photosensitive member-55 | 60 | 60 | 40 | 4 | 60 | 60 | 100,000 | 3 | 1 | 20 | 0.5 | 31 | 0 | 16 |
| Photosensitive member-56 | 60 | 60 | 40 | 6 | 60 | 60 | 100,000 | 5 | 1 | 21 | 0.5 | 40 | 0 | 16 |
| Photosensitive member-57 | 60 | 60 | 40 | 1 | 60 | 60 | 100,000 | 0.5 | 1 | 9 | 0.5 | 117 | 0 | 11 |
| Photosensitive member-58 | 60 | 60 | 40 | 4 | 60 | 60 | 100,000 | 3 | 1 | 10 | 0.5 | 109 | 0 | 11 |
| Photosensitive member-59 | 60 | 60 | 40 | 6 | 60 | 60 | 100,000 | 5 | 1 | 6 | 0.5 | 103 | 0 | 11 |
| Photosensitive member-60 | 60 | 60 | 64 | 1 | 60 | 60 | 160,000 | 0.5 | 1 | 20 | 0.5 | 29 | 0 | 16 |
| Photosensitive member-61 | 60 | 60 | 64 | 4 | 60 | 60 | 160,000 | 3 | 1 | 21 | 0.5 | 35 | 0 | 16 |
| Photosensitive member-62 | 60 | 60 | 64 | 6 | 60 | 60 | 160,000 | 5 | 1 | 17 | 0.5 | 46 | 0 | 16 |
| Photosensitive member-63 | 60 | 60 | 64 | 1 | 60 | 60 | 160,000 | 0.5 | 1 | 9 | 0.5 | 68 | 0 | 11 |
| Photosensitive member-64 | 60 | 60 | 64 | 4 | 60 | 60 | 160,000 | 3 | 1 | 6 | 0.5 | 59 | 0 | 11 |
| Photosensitive member-65 | 60 | 60 | 64 | 6 | 60 | 60 | 160,000 | 5 | 1 | 5 | 0.5 | 57 | 0 | 11 |

TABLE 1-continued

| | Mold | | | | Surface of electrophotographic photosensitive member | | | | | | | | | Abrading treatment |
|---|---|---|---|---|---|---|---|---|---|---|---|---|---|---|
| | Longest diameter [μm] | Shortest diameter [μm] | Area ratio [%] | Height (H) [μm] | Longest diameter of opening (Xmax) [μm] | Shortest diameter of opening (Xmin) [μm] | Area of opening [$\mu m^2$] | Depth of depressed portion (Z) [μm] | Standard deviation | Maximum width of line groove [μm] | Minimum width of line groove [μm] | Number of grooves each having width of 1 μm or more and 10 μm or less and length of 30 μm or more | Angle of line groove | Treatment time [s] |
| Photosensitive member-66 | 60 | 60 | 72 | 1 | 60 | 60 | 180,000 | 0.5 | 1 | 20 | 0.5 | 25 | 0 | 16 |
| Photosensitive member-67 | 60 | 60 | 72 | 4 | 60 | 60 | 180,000 | 3 | 1 | 20 | 0.5 | 31 | 0 | 16 |
| Photosensitive member-68 | 60 | 60 | 72 | 6 | 60 | 60 | 180,000 | 5 | 1 | 22 | 0.5 | 19 | 0 | 16 |
| Photosensitive member-69 | 60 | 60 | 72 | 1 | 60 | 60 | 180,000 | 0.5 | 1 | 6 | 0.5 | 51 | 0 | 11 |
| Photosensitive member-70 | 60 | 60 | 72 | 4 | 60 | 60 | 180,000 | 3 | 1 | 6 | 0.5 | 55 | 0 | 11 |
| Photosensitive member-71 | 60 | 60 | 72 | 6 | 60 | 60 | 180,000 | 5 | 1 | 7 | 0.5 | 50 | 0 | 11 |
| Photosensitive member-72 | 40 | 40 | 50 | 3 | 40 | 40 | 125,000 | 2 | 1 | 9 | 0.5 | 135 | 0 | 11 |
| Photosensitive member-73 | 50 | 50 | 50 | 3 | 50 | 50 | 125,000 | 2 | 1 | 9 | 0.5 | 126 | 0 | 11 |
| Photosensitive member-74 | 50 | 50 | 50 | 3 | 50 | 50 | 125,000 | 2 | 1 | 6 | 6 | 54 | 0 | — |
| Photosensitive member-75 | 50 | 50 | 50 | 3 | 50 | 50 | 125,000 | 2 | 1 | 6 | 6 | 50 | 10 | — |

(Real Machine Evaluation of Electrophotographic Photosensitive Member)

Example 1

The photosensitive member-1 was mounted onto the cyan station of a reconstructed machine of an electrophotographic apparatus (copying machine) manufactured by Canon Inc. (trade name: iR-ADV C5255) as an evaluation apparatus, and was tested and evaluated as described below.

First, conditions for a charging apparatus and an image-exposing apparatus were set so that the dark-area potential (Vd) and light-area potential (Vl) of the electrophotographic photosensitive member became −800 V and −300 V, respectively, under a 23° C./5% RH environment, and the initial potential of the electrophotographic photosensitive member was adjusted.

Next, a cleaning blade made of urethane rubber having a hardness of 77° was set so as to have an abutting angle of 28° and an abutting pressure (linear pressure) of 30 g/cm with respect to the surface (peripheral surface) of the electrophotographic photosensitive member. Under a state in which a heater (drum heater) for the electrophotographic photosensitive member was turned off, under a 23° C./5% RH environment, an A4 horizontal image having a print percentage of 1% (evaluation chart) was continuously output on 20,000 sheets. After that, a halftone image having a cyan density of 30% (screen image) was output, and a low-humidity streak on the image was evaluated as described below. Table 2 shows the result.

A: No streak (low-humidity streak) is found on the image.

E: A streak (low-humidity streak) is found on the image.

Next, conditions for the charging apparatus and the image-exposing apparatus were set so that the dark-area potential (Vd) and light-area potential (Vl) of the electrophotographic photosensitive member became −500 V and −180 V, respectively, under a 30° C./80% RH environment, and the initial potential of the electrophotographic photosensitive member was adjusted.

Next, the cleaning blade made of urethane rubber having a hardness of 77° was set so as to have an abutting angle of 28° and an abutting pressure (linear pressure) of 30 g/cm with respect to the surface (peripheral surface) of the electrophotographic photosensitive member. Under a state in which the heater (drum heater) for the electrophotographic photosensitive member was turned on, under a 30° C./80% RH environment, an A4 horizontal image having a print percentage of 1% (evaluation chart) was continuously output on 200 sheets. After that, a halftone image having a cyan density of 30% (screen image) was output, and a high-temperature/humidity streak on the image was evaluated as described below. Table 2 shows the result.

A: No streak (high-temperature/humidity streak) is found on the image.

B: What is suspected to be a streak (high-temperature/humidity streak) is found on the image, but is at a level where it is impossible to determine whether it is obviously a streak (high-temperature/humidity streak).

C: An extremely slight streak (high-temperature/humidity streak) is found on the image.

D: A slight streak (high-temperature/humidity streak) is found on the image.

E: A conspicuous streak (high-temperature/humidity streak) is found on the image.

Examples 2 to 235

Those shown in Table 2 were used as the electrophotographic photosensitive member, and the hardness and settings (abutting angle and abutting pressure (linear pressure)) of the cleaning blade were set as shown in Table 2. Real machine evaluation of the electrophotographic photosensitive members was performed in the same manner as in Example 1 except for these conditions. Table 2 shows the results.

TABLE 2

| | | Cleaning blade | | | Evaluation result | |
|---|---|---|---|---|---|---|
| | Electrophotographic photosensitive member | Hardness [°] | Abutting angle [°] | Abutting pressure [g/cm] | Low-humidity streak | High-temperature/humidity streak |
| Example 1 | Photosensitive member-1 | 77 | 28 | 30 | A | A |
| Example 2 | Photosensitive member-2 | 77 | 28 | 30 | A | A |
| Example 3 | Photosensitive member-3 | 77 | 28 | 30 | A | C |
| Example 4 | Photosensitive member-4 | 77 | 28 | 30 | A | C |
| Example 5 | Photosensitive member-5 | 77 | 28 | 30 | A | D |
| Example 6 | Photosensitive member-6 | 77 | 28 | 30 | A | B |
| Example 7 | Photosensitive member-7 | 77 | 28 | 30 | A | B |
| Example 8 | Photosensitive member-8 | 77 | 28 | 30 | A | C |
| Example 9 | Photosensitive member-9 | 77 | 28 | 30 | A | C |
| Example 10 | Photosensitive member-10 | 77 | 28 | 30 | A | C |
| Example 11 | Photosensitive member-11 | 77 | 28 | 30 | A | D |
| Example 12 | Photosensitive member-12 | 77 | 28 | 30 | A | C |
| Example 13 | Photosensitive member-13 | 77 | 28 | 30 | A | C |
| Example 14 | Photosensitive member-14 | 77 | 28 | 30 | A | D |

TABLE 2-continued

| | | Cleaning blade | | | Evaluation result | |
|---|---|---|---|---|---|---|
| | Electrophotographic photosensitive member | Hardness [°] | Abutting angle [°] | Abutting pressure [g/cm] | Low-humidity streak | High-temperature/humidity streak |
| Example 15 | Photosensitive member-15 | 77 | 28 | 30 | A | B |
| Example 16 | Photosensitive member-16 | 77 | 28 | 30 | A | B |
| Example 17 | Photosensitive member-17 | 77 | 28 | 30 | A | C |
| Example 18 | Photosensitive member-18 | 77 | 28 | 30 | A | C |
| Example 19 | Photosensitive member-19 | 77 | 28 | 30 | A | C |
| Example 20 | Photosensitive member-20 | 77 | 28 | 30 | A | D |
| Example 21 | Photosensitive member-21 | 77 | 28 | 30 | A | B |
| Example 22 | Photosensitive member-22 | 77 | 28 | 30 | A | B |
| Example 23 | Photosensitive member-23 | 77 | 28 | 30 | A | C |
| Example 24 | Photosensitive member-24 | 77 | 28 | 30 | A | C |
| Example 25 | Photosensitive member-25 | 77 | 28 | 30 | A | C |
| Example 26 | Photosensitive member-26 | 77 | 28 | 30 | A | D |
| Example 27 | Photosensitive member-27 | 77 | 28 | 30 | A | B |
| Example 28 | Photosensitive member-28 | 77 | 28 | 30 | A | B |
| Example 29 | Photosensitive member-29 | 77 | 28 | 30 | A | C |
| Example 30 | Photosensitive member-30 | 77 | 28 | 30 | A | B |
| Example 31 | Photosensitive member-31 | 77 | 28 | 30 | A | B |
| Example 32 | Photosensitive member-32 | 77 | 28 | 30 | A | C |
| Example 33 | Photosensitive member-33 | 77 | 28 | 30 | A | A |
| Example 34 | Photosensitive member-34 | 77 | 28 | 30 | A | A |
| Example 35 | Photosensitive member-35 | 77 | 28 | 30 | A | B |
| Example 36 | Photosensitive member-36 | 77 | 28 | 30 | A | B |
| Example 37 | Photosensitive member-37 | 77 | 28 | 30 | A | B |
| Example 38 | Photosensitive member-38 | 77 | 28 | 30 | A | C |
| Example 39 | Photosensitive member-39 | 77 | 28 | 30 | A | A |
| Example 40 | Photosensitive member-40 | 77 | 28 | 30 | A | A |
| Example 41 | Photosensitive member-41 | 77 | 28 | 30 | A | B |
| Example 42 | Photosensitive member-42 | 77 | 28 | 30 | A | C |
| Example 43 | Photosensitive member-43 | 77 | 28 | 30 | A | C |
| Example 44 | Photosensitive member-44 | 77 | 28 | 30 | A | D |
| Example 45 | Photosensitive member-45 | 77 | 28 | 30 | A | B |
| Example 46 | Photosensitive member-46 | 77 | 28 | 30 | A | B |
| Example 47 | Photosensitive member-47 | 77 | 28 | 30 | A | C |
| Example 48 | Photosensitive member-48 | 77 | 28 | 30 | A | C |
| Example 49 | Photosensitive member-49 | 77 | 28 | 30 | A | C |
| Example 50 | Photosensitive member-50 | 77 | 28 | 30 | A | D |
| Example 51 | Photosensitive member-51 | 77 | 28 | 30 | A | B |

TABLE 2-continued

| | | Cleaning blade | | | Evaluation result | |
|---|---|---|---|---|---|---|
| | Electrophotographic photosensitive member | Hardness [°] | Abutting angle [°] | Abutting pressure [g/cm] | Low-humidity streak | High-temperature/humidity streak |
| Example 52 | Photosensitive member-52 | 77 | 28 | 30 | A | B |
| Example 53 | Photosensitive member-53 | 77 | 28 | 30 | A | C |
| Example 54 | Photosensitive member-54 | 77 | 28 | 30 | A | B |
| Example 55 | Photosensitive member-55 | 77 | 28 | 30 | A | B |
| Example 56 | Photosensitive member-56 | 77 | 28 | 30 | A | C |
| Example 57 | Photosensitive member-57 | 77 | 28 | 30 | A | A |
| Example 58 | Photosensitive member-58 | 77 | 28 | 30 | A | A |
| Example 59 | Photosensitive member-59 | 77 | 28 | 30 | A | B |
| Example 60 | Photosensitive member-60 | 77 | 28 | 30 | A | B |
| Example 61 | Photosensitive member-61 | 77 | 28 | 30 | A | B |
| Example 62 | Photosensitive member-62 | 77 | 28 | 30 | A | C |
| Example 63 | Photosensitive member-63 | 77 | 28 | 30 | A | A |
| Example 64 | Photosensitive member-64 | 77 | 28 | 30 | A | A |
| Example 65 | Photosensitive member-65 | 77 | 28 | 30 | A | B |
| Example 66 | Photosensitive member-66 | 77 | 28 | 30 | A | C |
| Example 67 | Photosensitive member-67 | 77 | 28 | 30 | A | C |
| Example 68 | Photosensitive member-68 | 77 | 28 | 30 | A | D |
| Example 69 | Photosensitive member-69 | 77 | 28 | 30 | A | B |
| Example 70 | Photosensitive member-70 | 77 | 28 | 30 | A | B |
| Example 71 | Photosensitive member-71 | 77 | 28 | 30 | A | C |
| Example 72 | Photosensitive member-72 | 77 | 28 | 30 | A | A |
| Example 73 | Photosensitive member-73 | 77 | 28 | 30 | A | A |
| Example 74 | Photosensitive member-74 | 77 | 28 | 30 | A | A |
| Example 75 | Photosensitive member-75 | 77 | 28 | 30 | A | A |
| Example 76 | Photosensitive member-1 | 65 | 28 | 15 | A | A |
| Example 77 | Photosensitive member-2 | 65 | 28 | 15 | A | A |
| Example 78 | Photosensitive member-3 | 65 | 28 | 15 | A | C |
| Example 79 | Photosensitive member-4 | 65 | 28 | 15 | A | C |
| Example 80 | Photosensitive member-5 | 65 | 28 | 15 | A | D |
| Example 81 | Photosensitive member-6 | 65 | 28 | 15 | A | B |
| Example 82 | Photosensitive member-7 | 65 | 28 | 15 | A | B |
| Example 83 | Photosensitive member-8 | 65 | 28 | 15 | A | C |
| Example 84 | Photosensitive member-9 | 65 | 28 | 15 | A | C |
| Example 85 | Photosensitive member-10 | 65 | 28 | 15 | A | C |
| Example 86 | Photosensitive member-11 | 65 | 28 | 15 | A | D |
| Example 87 | Photosensitive member-12 | 65 | 28 | 15 | A | C |
| Example 88 | Photosensitive member-13 | 65 | 28 | 15 | A | C |

TABLE 2-continued

| | | Cleaning blade | | | Evaluation result | |
|---|---|---|---|---|---|---|
| | Electrophotographic photosensitive member | Hardness [°] | Abutting angle [°] | Abutting pressure [g/cm] | Low-humidity streak | High-temperature/humidity streak |
| Example 89 | Photosensitive member-14 | 65 | 28 | 15 | A | D |
| Example 90 | Photosensitive member-15 | 65 | 28 | 15 | A | B |
| Example 91 | Photosensitive member-16 | 65 | 28 | 15 | A | B |
| Example 92 | Photosensitive member-17 | 65 | 28 | 15 | A | C |
| Example 93 | Photosensitive member-18 | 65 | 28 | 15 | A | C |
| Example 94 | Photosensitive member-19 | 65 | 28 | 15 | A | C |
| Example 95 | Photosensitive member-20 | 65 | 28 | 15 | A | D |
| Example 96 | Photosensitive member-21 | 65 | 28 | 15 | A | B |
| Example 97 | Photosensitive member-22 | 65 | 28 | 15 | A | B |
| Example 98 | Photosensitive member-23 | 65 | 28 | 15 | A | C |
| Example 99 | Photosensitive member-24 | 65 | 28 | 15 | A | C |
| Example 100 | Photosensitive member-25 | 65 | 28 | 15 | A | C |
| Example 101 | Photosensitive member-26 | 65 | 28 | 15 | A | D |
| Example 102 | Photosensitive member-27 | 65 | 28 | 15 | A | B |
| Example 103 | Photosensitive member-28 | 65 | 28 | 15 | A | B |
| Example 104 | Photosensitive member-29 | 65 | 28 | 15 | A | C |
| Example 105 | Photosensitive member-30 | 65 | 28 | 15 | A | B |
| Example 106 | Photosensitive member-31 | 65 | 28 | 15 | A | B |
| Example 107 | Photosensitive member-32 | 65 | 28 | 15 | A | C |
| Example 108 | Photosensitive member-33 | 65 | 28 | 15 | A | A |
| Example 109 | Photosensitive member-34 | 65 | 28 | 15 | A | A |
| Example 110 | Photosensitive member-35 | 65 | 28 | 15 | A | B |
| Example 111 | Photosensitive member-36 | 65 | 28 | 15 | A | B |
| Example 112 | Photosensitive member-37 | 65 | 28 | 15 | A | B |
| Example 113 | Photosensitive member-38 | 65 | 28 | 15 | A | C |
| Example 114 | Photosensitive member-39 | 65 | 28 | 15 | A | A |
| Example 115 | Photosensitive member-40 | 65 | 28 | 15 | A | A |
| Example 116 | Photosensitive member-41 | 65 | 28 | 15 | A | B |
| Example 117 | Photosensitive member-42 | 65 | 28 | 15 | A | C |
| Example 118 | Photosensitive member-43 | 65 | 28 | 15 | A | C |
| Example 119 | Photosensitive member-44 | 65 | 28 | 15 | A | D |
| Example 120 | Photosensitive member-45 | 65 | 28 | 15 | A | B |
| Example 121 | Photosensitive member-46 | 65 | 28 | 15 | A | B |
| Example 122 | Photosensitive member-47 | 65 | 28 | 15 | A | C |
| Example 123 | Photosensitive member-48 | 65 | 28 | 15 | A | C |
| Example 124 | Photosensitive member-49 | 65 | 28 | 15 | A | C |
| Example 125 | Photosensitive member-50 | 65 | 28 | 15 | A | D |

TABLE 2-continued

| | | Cleaning blade | | | Evaluation result | |
|---|---|---|---|---|---|---|
| | Electrophotographic photosensitive member | Hardness [°] | Abutting angle [°] | Abutting pressure [g/cm] | Low-humidity streak | High-temperature/humidity streak |
| Example 126 | Photosensitive member-51 | 65 | 28 | 15 | A | B |
| Example 127 | Photosensitive member-52 | 65 | 28 | 15 | A | B |
| Example 128 | Photosensitive member-53 | 65 | 28 | 15 | A | C |
| Example 129 | Photosensitive member-54 | 65 | 28 | 15 | A | B |
| Example 130 | Photosensitive member-55 | 65 | 28 | 15 | A | B |
| Example 131 | Photosensitive member-56 | 65 | 28 | 15 | A | C |
| Example 132 | Photosensitive member-57 | 65 | 28 | 15 | A | A |
| Example 133 | Photosensitive member-58 | 65 | 28 | 15 | A | A |
| Example 134 | Photosensitive member-59 | 65 | 28 | 15 | A | B |
| Example 135 | Photosensitive member-60 | 65 | 28 | 15 | A | B |
| Example 136 | Photosensitive member-61 | 65 | 28 | 15 | A | B |
| Example 137 | Photosensitive member-62 | 65 | 28 | 15 | A | C |
| Example 138 | Photosensitive member-63 | 65 | 28 | 15 | A | A |
| Example 139 | Photosensitive member-64 | 65 | 28 | 15 | A | A |
| Example 140 | Photosensitive member-65 | 65 | 28 | 15 | A | B |
| Example 141 | Photosensitive member-66 | 65 | 28 | 15 | A | C |
| Example 142 | Photosensitive member-67 | 65 | 28 | 15 | A | C |
| Example 143 | Photosensitive member-68 | 65 | 28 | 15 | A | D |
| Example 144 | Photosensitive member-69 | 65 | 28 | 15 | A | B |
| Example 145 | Photosensitive member-70 | 65 | 28 | 15 | A | B |
| Example 146 | Photosensitive member-71 | 65 | 28 | 15 | A | C |
| Example 147 | Photosensitive member-72 | 65 | 28 | 15 | A | A |
| Example 148 | Photosensitive member-73 | 65 | 28 | 15 | A | A |
| Example 149 | Photosensitive member-74 | 65 | 28 | 15 | A | A |
| Example 150 | Photosensitive member-75 | 65 | 28 | 15 | A | A |
| Example 151 | Photosensitive member-1 | 80 | 28 | 45 | A | A |
| Example 152 | Photosensitive member-2 | 80 | 28 | 45 | A | A |
| Example 153 | Photosensitive member-3 | 80 | 28 | 45 | A | C |
| Example 154 | Photosensitive member-4 | 80 | 28 | 45 | A | C |
| Example 155 | Photosensitive member-5 | 80 | 28 | 45 | A | D |
| Example 156 | Photosensitive member-6 | 80 | 28 | 45 | A | B |
| Example 157 | Photosensitive member-7 | 80 | 28 | 45 | A | B |
| Example 158 | Photosensitive member-8 | 80 | 28 | 45 | A | C |
| Example 159 | Photosensitive member-9 | 80 | 28 | 45 | A | C |
| Example 160 | Photosensitive member-10 | 80 | 28 | 45 | A | C |
| Example 161 | Photosensitive member-11 | 80 | 28 | 45 | A | D |
| Example 162 | Photosensitive member-12 | 80 | 28 | 45 | A | C |

TABLE 2-continued

| | | Cleaning blade | | | Evaluation result | |
|---|---|---|---|---|---|---|
| | Electrophotographic photosensitive member | Hardness [°] | Abutting angle [°] | Abutting pressure [g/cm] | Low-humidity streak | High-temperature/humidity streak |
| Example 163 | Photosensitive member-13 | 80 | 28 | 45 | A | C |
| Example 164 | Photosensitive member-14 | 80 | 28 | 45 | A | D |
| Example 165 | Photosensitive member-15 | 80 | 28 | 45 | A | B |
| Example 166 | Photosensitive member-16 | 80 | 28 | 45 | A | B |
| Example 167 | Photosensitive member-17 | 80 | 28 | 45 | A | C |
| Example 168 | Photosensitive member-18 | 80 | 28 | 45 | A | C |
| Example 169 | Photosensitive member-19 | 80 | 28 | 45 | A | C |
| Example 170 | Photosensitive member-20 | 80 | 28 | 45 | A | D |
| Example 171 | Photosensitive member-21 | 80 | 28 | 45 | A | B |
| Example 172 | Photosensitive member-22 | 80 | 28 | 45 | A | B |
| Example 173 | Photosensitive member-23 | 80 | 28 | 45 | A | C |
| Example 174 | Photosensitive member-24 | 80 | 28 | 45 | A | C |
| Example 175 | Photosensitive member-25 | 80 | 28 | 45 | A | C |
| Example 176 | Photosensitive member-26 | 80 | 28 | 45 | A | D |
| Example 177 | Photosensitive member-27 | 80 | 28 | 45 | A | B |
| Example 178 | Photosensitive member-28 | 80 | 28 | 45 | A | B |
| Example 179 | Photosensitive member-29 | 80 | 28 | 45 | A | C |
| Example 180 | Photosensitive member-30 | 80 | 28 | 45 | A | B |
| Example 181 | Photosensitive member-31 | 80 | 28 | 45 | A | B |
| Example 182 | Photosensitive member-32 | 80 | 28 | 45 | A | C |
| Example 183 | Photosensitive member-33 | 80 | 28 | 45 | A | A |
| Example 184 | Photosensitive member-34 | 80 | 28 | 45 | A | A |
| Example 185 | Photosensitive member-35 | 80 | 28 | 45 | A | B |
| Example 186 | Photosensitive member-36 | 80 | 28 | 45 | A | B |
| Example 187 | Photosensitive member-37 | 80 | 28 | 45 | A | B |
| Example 188 | Photosensitive member-38 | 80 | 28 | 45 | A | C |
| Example 189 | Photosensitive member-39 | 80 | 28 | 45 | A | A |
| Example 190 | Photosensitive member-40 | 80 | 28 | 45 | A | A |
| Example 191 | Photosensitive member-41 | 80 | 28 | 45 | A | B |
| Example 192 | Photosensitive member-42 | 80 | 28 | 45 | A | C |
| Example 193 | Photosensitive member-43 | 80 | 28 | 45 | A | C |
| Example 194 | Photosensitive member-44 | 80 | 28 | 45 | A | D |
| Example 195 | Photosensitive member-45 | 80 | 28 | 45 | A | B |
| Example 196 | Photosensitive member-46 | 80 | 28 | 45 | A | B |
| Example 197 | Photosensitive member-47 | 80 | 28 | 45 | A | C |
| Example 198 | Photosensitive member-48 | 80 | 28 | 45 | A | C |
| Example 199 | Photosensitive member-49 | 80 | 28 | 45 | A | C |

TABLE 2-continued

| | | Cleaning blade | | | Evaluation result | |
|---|---|---|---|---|---|---|
| | Electrophotographic photosensitive member | Hardness [°] | Abutting angle [°] | Abutting pressure [g/cm] | Low-humidity streak | High-temperature/humidity streak |
| Example 200 | Photosensitive member-50 | 80 | 28 | 45 | A | D |
| Example 201 | Photosensitive member-51 | 80 | 28 | 45 | A | B |
| Example 202 | Photosensitive member-52 | 80 | 28 | 45 | A | B |
| Example 203 | Photosensitive member-53 | 80 | 28 | 45 | A | C |
| Example 204 | Photosensitive member-54 | 80 | 28 | 45 | A | B |
| Example 205 | Photosensitive member-55 | 80 | 28 | 45 | A | B |
| Example 206 | Photosensitive member-56 | 80 | 28 | 45 | A | C |
| Example 207 | Photosensitive member-57 | 80 | 28 | 45 | A | A |
| Example 208 | Photosensitive member-58 | 80 | 28 | 45 | A | A |
| Example 209 | Photosensitive member-59 | 80 | 28 | 45 | A | B |
| Example 210 | Photosensitive member-60 | 80 | 28 | 45 | A | B |
| Example 211 | Photosensitive member-61 | 80 | 28 | 45 | A | B |
| Example 212 | Photosensitive member-62 | 80 | 28 | 45 | A | C |
| Example 213 | Photosensitive member-63 | 80 | 28 | 45 | A | A |
| Example 214 | Photosensitive member-64 | 80 | 28 | 45 | A | A |
| Example 215 | Photosensitive member-65 | 80 | 28 | 45 | A | B |
| Example 216 | Photosensitive member-66 | 80 | 28 | 45 | A | C |
| Example 217 | Photosensitive member-67 | 80 | 28 | 45 | A | C |
| Example 218 | Photosensitive member-68 | 80 | 28 | 45 | A | D |
| Example 219 | Photosensitive member-69 | 80 | 28 | 45 | A | B |
| Example 220 | Photosensitive member-70 | 80 | 28 | 45 | A | B |
| Example 221 | Photosensitive member-71 | 80 | 28 | 45 | A | C |
| Example 222 | Photosensitive member-72 | 80 | 28 | 45 | A | A |
| Example 223 | Photosensitive member-73 | 80 | 28 | 45 | A | A |
| Example 224 | Photosensitive member-74 | 80 | 28 | 45 | A | A |
| Example 225 | Photosensitive member-75 | 80 | 28 | 45 | A | A |
| Example 226 | Photosensitive member-1 | 77 | 28 | 15 | A | A |
| Example 227 | Photosensitive member-2 | 77 | 28 | 15 | A | A |
| Example 228 | Photosensitive member-1 | 65 | 28 | 30 | A | A |
| Example 229 | Photosensitive member-2 | 65 | 28 | 30 | A | A |
| Example 230 | Photosensitive member-1 | 80 | 28 | 30 | A | A |
| Example 231 | Photosensitive member-2 | 80 | 28 | 30 | A | A |
| Example 232 | Photosensitive member-1 | 77 | 28 | 45 | A | A |
| Example 233 | Photosensitive member-2 | 77 | 28 | 45 | A | A |
| Example 234 | Photosensitive member-1 | 77 | 22 | 30 | A | A |
| Example 235 | Photosensitive member-2 | 77 | 22 | 30 | A | A |

(Production Example of Photosensitive Member-101)

In the production example of the photosensitive member-1, the mold was changed as shown in Table 3, and the abrading treatment was not performed. An electrophotographic photosensitive member "photosensitive member-101" was produced in the same manner as in the production example of the photosensitive member-1 except for these conditions. The surface of the resultant electrophotographic photosensitive member was observed in the same manner as in the production example of the photosensitive member-1. Table 3 shows the results. (Production Example of Photosensitive member-102)

In the production example of the photosensitive member-1, the mold was changed as shown in Table 3, and the abrading treatment was not performed. An electrophotographic photosensitive member was produced in the same manner as in the production example of the photosensitive member-1 except for these conditions. This electrophotographic photosensitive member is defined as "photosensitive member-102". The surface of the resultant electrophotographic photosensitive member was observed in the same manner as in the production example of the photosensitive member-1. Table 3 shows the results.

(Production Example of Photosensitive Member-103)

In the production example of the photosensitive member-1, the mold and the abrading treatment time were changed as shown in Table 3. An electrophotographic photosensitive member was produced in the same manner as in the production example of the photosensitive member-1 except for these conditions. This electrophotographic photosensitive member is defined as "photosensitive member-103". The surface of the resultant electrophotographic photosensitive member was observed in the same manner as in the production example of the photosensitive member-1. Table 3 shows the results.

(Production Example of Photosensitive Member-104)

In the production example of the photosensitive member-1, the mold and the abrading treatment time were changed as shown in Table 3, and an abrasive sheet (GC5000) manufactured by RIKEN CORUNDUM CO., LTD. was used in place of the abrasive sheet (GC3000). An electrophotographic photosensitive member was produced in the same manner as in the production example of the photosensitive member-1 except for these conditions. This electrophotographic photosensitive member is defined as "photosensitive member-104". The surface of the resultant electrophotographic photosensitive member was observed in the same manner as in the production example of the photosensitive member-1. Table 3 shows the results.

(Production Examples of Photosensitive Member-105 to Photosensitive Member-108)

In the production example of the photosensitive member-1, the mold and the abrading treatment time were changed as shown in Table 3. Electrophotographic photosensitive members were produced in the same manner as in the production example of the photosensitive member-1 except for these conditions. These electrophotographic photosensitive members are defined as "photosensitive member-105 to photosensitive member-108". The surface of each of the resultant electrophotographic photosensitive members was observed in the same manner as in the production example of the photosensitive member-1. Table 3 shows the results.

(Production Examples of Photosensitive Member-109 and Photosensitive Member-110)

Cylindrical electrophotographic photosensitive members before the formation of depressed portions and line grooves on their surfaces (electrophotographic photosensitive members before depressed portion/line groove formation) were produced in the same manner as in the production example of the photosensitive member-1.

Next, a mold as illustrated in FIG. 8B was used and a shape corresponding to the shape of the mold was formed on the entire surface (peripheral surface) of each of the electrophotographic photosensitive members by a method similar to that for the photosensitive member-1. These electrophotographic photosensitive members are defined as "photosensitive member-109 and photosensitive member-110". The surface of each of the resultant electrophotographic photosensitive members was observed in the same manner as in the production example of the photosensitive member-1. Table 3 shows the results.

TABLE 3

| | Mold | | | | Surface of electrophotographic photosensitive member | | | |
|---|---|---|---|---|---|---|---|---|
| | Longest diameter [μm] | Shortest diameter [μm] | Area ratio [%] | Height (H) [μm] | Longest diameter of opening (Xmax) [μm] | Shortest diameter of opening (Xmin) [μm] | Area of opening [μm$^2$] | Depth of depressed portion (Z) [μm] |
| Photosensitive member-101 | 50 | 50 | 20 | 3 | 50 | 50 | 50,000 | 2 |
| Photosensitive member-102 | 52 | 52 | 50 | 3 | 50 | 50 | 125,000 | 2 |
| Photosensitive member-103 | 50 | 50 | 20 | 2 | 50 | 50 | 50,000 | 2 |
| Photosensitive member-104 | 20 | 20 | 20 | 0.5 | 20 | 20 | 95,000 | 0.2 |
| Photosensitive member-105 | 20 | 20 | 20 | 3 | 20 | 20 | 90,000 | 2 |
| Photosensitive member-106 | 20 | 20 | 20 | 8 | 20 | 20 | 95,000 | 6 |
| Photosensitive member-107 | 15 | 15 | 50 | 4 | 15 | 15 | 125,000 | 2 |
| Photosensitive member-108 | 90 | 90 | 50 | 4 | 90 | 90 | 125,000 | 2 |
| Photosensitive member-109 | 50 | 50 | 50 | 2 | 50 | 50 | 125,000 | 2 |

TABLE 3-continued

| | | | | | | | |
|---|---|---|---|---|---|---|---|
| Photosensitive member-110 | 50 | 50 | 50 | 2 | 50 | 50 | 125,000 | 2 |

| | Surface of electrophotographic photosensitive member | | | | | |
|---|---|---|---|---|---|---|
| | Standard deviation | Maximum width of line groove [μm] | Minimum width of line groove [μm] | Number of grooves each having width of 1 μm or more and 10 μm or less and length of 30 μm or more | Angle of line groove | Abrading treatment Treatment time [s] |
| Photosensitive member-101 | 1 | — | — | — | — | — |
| Photosensitive member-102 | 1 | — | — | — | — | — |
| Photosensitive member-103 | 1 | 10 | 0.5 | 210 | 0 | 11 |
| Photosensitive member-104 | 1 | 20 | 0.5 | 123 | 0 | 5 |
| Photosensitive member-105 | 1 | 20 | 0.5 | 105 | 0 | 5 |
| Photosensitive member-106 | 1 | 20 | 0.5 | 101 | 0 | 5 |
| Photosensitive member-107 | 1 | 20 | 0.5 | 119 | 0 | 5 |
| Photosensitive member-108 | 1 | 20 | 0.5 | 150 | 0 | 5 |
| Photosensitive member-109 | 1 | 50 | 20 | 0 | 0 | — |
| Photosensitive member-110 | 1 | 0.3 | 0.2 | 0 | 0 | — |

Comparative Examples 1 to 60

Those shown in Table 4 were used as the electrophotographic photosensitive member, and the hardness and settings (abutting angle and abutting pressure (linear pressure)) of the cleaning blade were set as shown in Table 4. Real machine evaluation of the electrophotographic photosensitive members was performed in the same manner as in Example 1 except for these conditions. Table 4 shows the results.

TABLE 4

| | | Cleaning blade | | | Evaluation result | |
|---|---|---|---|---|---|---|
| | Electrophotographic photosensitive member | Hardness [°] | Abutting angle [°] | Abutting pressure [g/cm] | Low-humidity streak | High-temperature/humidity streak |
| Comparative Example 1 | Photosensitive member-101 | 77 | 28 | 15 | E | E |
| Comparative Example 2 | Photosensitive member-102 | 77 | 28 | 15 | A | E |
| Comparative Example 3 | Photosensitive member-103 | 77 | 28 | 15 | E | A |
| Comparative Example 4 | Photosensitive member-104 | 77 | 28 | 15 | E | A |
| Comparative Example 5 | Photosensitive member-105 | 77 | 28 | 15 | E | A |
| Comparative Example 6 | Photosensitive member-106 | 77 | 28 | 15 | E | A |
| Comparative Example 7 | Photosensitive member-107 | 77 | 28 | 15 | E | A |
| Comparative Example 8 | Photosensitive member-108 | 77 | 28 | 15 | E | A |
| Comparative Example 9 | Photosensitive member-109 | 77 | 28 | 15 | A | E |
| Comparative Example 10 | Photosensitive member-110 | 77 | 28 | 15 | A | E |
| Comparative Example 11 | Photosensitive member-101 | 65 | 28 | 15 | E | E |

TABLE 4-continued

| | | Cleaning blade | | | Evaluation result | |
|---|---|---|---|---|---|---|
| | Electrophotographic photosensitive member | Hardness [°] | Abutting angle [°] | Abutting pressure [g/cm] | Low-humidity streak | High-temperature/humidity streak |
| Comparative Example 12 | Photosensitive member-102 | 65 | 28 | 15 | A | E |
| Comparative Example 13 | Photosensitive member-103 | 65 | 28 | 15 | E | A |
| Comparative Example 14 | Photosensitive member-104 | 65 | 28 | 15 | E | A |
| Comparative Example 15 | Photosensitive member-105 | 65 | 28 | 15 | E | A |
| Comparative Example 16 | Photosensitive member-106 | 65 | 28 | 15 | E | A |
| Comparative Example 17 | Photosensitive member-107 | 65 | 28 | 15 | E | A |
| Comparative Example 18 | Photosensitive member-108 | 65 | 28 | 15 | E | A |
| Comparative Example 19 | Photosensitive member-109 | 65 | 28 | 15 | A | E |
| Comparative Example 20 | Photosensitive member-110 | 65 | 28 | 15 | A | E |
| Comparative Example 21 | Photosensitive member-101 | 80 | 28 | 15 | E | E |
| Comparative Example 22 | Photosensitive member-102 | 80 | 28 | 15 | A | E |
| Comparative Example 23 | Photosensitive member-103 | 80 | 28 | 15 | E | A |
| Comparative Example 24 | Photosensitive member-104 | 80 | 28 | 15 | E | A |
| Comparative Example 25 | Photosensitive member-105 | 80 | 28 | 15 | E | A |
| Comparative Example 26 | Photosensitive member-106 | 80 | 28 | 15 | E | A |
| Comparative Example 27 | Photosensitive member-107 | 80 | 28 | 15 | E | A |
| Comparative Example 28 | Photosensitive member-108 | 80 | 28 | 15 | E | A |
| Comparative Example 29 | Photosensitive member-109 | 80 | 28 | 15 | A | E |
| Comparative Example 30 | Photosensitive member-110 | 80 | 28 | 15 | A | E |
| Comparative Example 31 | Photosensitive member-101 | 77 | 28 | 45 | E | E |
| Comparative Example 32 | Photosensitive member-102 | 77 | 28 | 45 | A | E |
| Comparative Example 33 | Photosensitive member-103 | 77 | 28 | 45 | E | A |
| Comparative Example 34 | Photosensitive member-104 | 77 | 28 | 45 | E | A |
| Comparative Example 35 | Photosensitive member-105 | 77 | 28 | 45 | E | A |
| Comparative Example 36 | Photosensitive member-106 | 77 | 28 | 45 | E | A |
| Comparative Example 37 | Photosensitive member-107 | 77 | 28 | 45 | E | A |
| Comparative Example 38 | Photosensitive member-108 | 77 | 28 | 45 | E | A |
| Comparative Example 39 | Photosensitive member-109 | 77 | 28 | 45 | A | E |
| Comparative Example 40 | Photosensitive member-110 | 77 | 28 | 45 | A | E |
| Comparative Example 41 | Photosensitive member-101 | 65 | 28 | 45 | E | E |
| Comparative Example 42 | Photosensitive member-102 | 65 | 28 | 45 | A | E |
| Comparative Example 43 | Photosensitive member-103 | 65 | 28 | 45 | E | A |
| Comparative Example 44 | Photosensitive member-104 | 65 | 28 | 45 | E | A |
| Comparative Example 45 | Photosensitive member-105 | 65 | 28 | 45 | E | A |
| Comparative Example 46 | Photosensitive member-106 | 65 | 28 | 45 | E | A |
| Comparative Example 47 | Photosensitive member-107 | 65 | 28 | 45 | E | A |
| Comparative Example 48 | Photosensitive member-108 | 65 | 28 | 45 | E | A |

TABLE 4-continued

| | Electrophotographic photosensitive member | Cleaning blade Hardness [°] | Abutting angle [°] | Abutting pressure [g/cm] | Evaluation result Low-humidity streak | High-temperature/humidity streak |
|---|---|---|---|---|---|---|
| Comparative Example 49 | Photosensitive member-109 | 65 | 28 | 45 | A | E |
| Comparative Example 50 | Photosensitive member-110 | 65 | 28 | 45 | A | E |
| Comparative Example 51 | Photosensitive member-101 | 80 | 28 | 45 | E | E |
| Comparative Example 52 | Photosensitive member-102 | 80 | 28 | 45 | A | E |
| Comparative Example 53 | Photosensitive member-103 | 80 | 28 | 45 | E | A |
| Comparative Example 54 | Photosensitive member-104 | 80 | 28 | 45 | E | A |
| Comparative Example 55 | Photosensitive member-105 | 80 | 28 | 45 | E | A |
| Comparative Example 56 | Photosensitive member-106 | 80 | 28 | 45 | E | A |
| Comparative Example 57 | Photosensitive member-107 | 80 | 28 | 45 | E | A |
| Comparative Example 58 | Photosensitive member-108 | 80 | 28 | 45 | E | A |
| Comparative Example 59 | Photosensitive member-109 | 80 | 28 | 45 | A | E |
| Comparative Example 60 | Photosensitive member-110 | 80 | 28 | 45 | A | E |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-032157, filed Feb. 21, 2014 and Japanese Patent Application No. 2015-014329, filed Jan. 28, 2015 which are hereby incorporated by reference herein in their entirety.

What is claimed is:

1. An electrophotographic photosensitive member, comprising:

a cylindrical support; and a photosensitive layer formed on the support, wherein a surface of the electrophotographic photosensitive member has:

a plurality of depressed portions each having a depth of 0.5 μm or more and 5 μm or less and a longest diameter of an opening of 20 μm or more and 80 μm or less; and a plurality of line grooves formed at portions other than the plurality of depressed portions, the plurality of line grooves each having a width in a generatrix line direction of the electrophotographic photosensitive member of 0.5 μm or more and 15 μm or less and forming an angle of 80° or more and 100° or less with respect to the generatrix line direction, and wherein when a square region 500 μm on a side is arranged at an arbitrary position of the surface of the electrophotographic photosensitive member, an area of the plurality of depressed portions in the square region 500 μm on a side is 95,000 $\mu m^2$ or more and 180,000 $\mu m^2$ or less.

2. An electrophotographic photosensitive member, comprising:

a cylindrical support; and a photosensitive layer formed on the support, wherein at least a contact area with a cleaning blade of a surface of the electrophotographic photosensitive member has:

a plurality of depressed portions each having a depth of 0.5 μm or more and 5 μm or less and a longest diameter of an opening of 20 μm or more and 80 μm or less; and a plurality of line grooves formed at portions other than the plurality of depressed portions, the plurality of line grooves each having a width in a generatrix line direction of the electrophotographic photosensitive member of 0.5 μm or more and 15 μm or less and forming an angle of 80° or more and 100° or less with respect to the generatrix line direction, and wherein when a square region 500 μm on a side is arranged at an arbitrary position of the contact area, an area of the plurality of depressed portions in the square region 500 μm on a side is 95,000 $\mu m^2$ or more and 180,000 $\mu m^2$ or less.

3. An electrophotographic photosensitive member according to claim 1, wherein 50 or more line grooves each having a width in the generatrix line direction of the electrophotographic photosensitive member of 1 μm or more and 10 μm or less and a length in a circumferential direction of the electrophotographic photosensitive member of 30 μm or more are present in the square region 500 μm on a side.

4. An electrophotographic photosensitive member according to claim 1, wherein the plurality of depressed portions each have a shortest diameter of the opening of 20 μm or more and 80 μm or less.

5. An electrophotographic photosensitive member according to claim 1, wherein the plurality of depressed portions each have a longest diameter of the opening of 30 μm or more and 60 μm or less, wherein the plurality of depressed portions each have a shortest diameter of the opening of 30 μm or more and 60 μm or less, and wherein the area of the plurality of depressed portions in the square region is 100,000 $\mu m^2$ or more and 160,000 $\mu m^2$ or less.

6. An electrophotographic photosensitive member according to claim 1, wherein the plurality of depressed portions each have a depth of 0.5 μm or more and 3 μm or less.

7. An electrophotographic photosensitive member according to claim 1, wherein when the area of the plurality of depressed portions is measured in the square region 500 μm on a side arranged at each of 50 arbitrary locations of the surface of the electrophotographic photosensitive member, a standard deviation of measured values for the area of the plurality of depressed portions at the 50 arbitrary locations is 5% or less.

8. An electrophotographic photosensitive member according to claim 1, wherein the plurality of line grooves have a depth of 0.01 μm or more and 0.05 μm or less on average.

9. A process cartridge, comprising:

the electrophotographic photosensitive member according to claim 1; and a cleaning unit including a cleaning blade arranged so as to be brought into contact with the electrophotographic photosensitive member, the electrophotographic photosensitive member and the cleaning unit being integrally supported, wherein the process cartridge is removably mounted onto a main body of an electrophotographic apparatus.

10. An electrophotographic apparatus, comprising:

the electrophotographic photosensitive member according to claim 1;

a charging unit;

an exposing unit;

a developing unit;

a transferring unit; and a cleaning unit including a cleaning blade arranged so as to be brought into contact with the electrophotographic photosensitive member.

11. An electrophotographic photosensitive member according to claim 2, wherein 50 or more line grooves each having a width in the generatrix line direction of the electrophotographic photosensitive member of 1 μm or more and 10 μm or less and a length in a circumferential direction of the electrophotographic photosensitive member of 30 μm or more are present in the square region 500 μm on a side.

12. An electrophotographic photosensitive member according to claim 2, wherein the plurality of depressed portions each have a shortest diameter of the opening of 20 μm or more and 80 μm or less.

13. An electrophotographic photosensitive member according to claim 2, wherein the plurality of depressed portions each have a longest diameter of the opening of 30 μm or more and 60 μm or less, wherein the plurality of depressed portions each have a shortest diameter of the opening of 30 μm or more and 60 μm or less, and wherein the area of the plurality of depressed portions in the square region is 100,000 $\mu m^2$ or more and 160,000 $\mu m^2$ or less.

14. An electrophotographic photosensitive member according to claim 2, wherein the plurality of depressed portions each have a depth of 0.5 μm or more and 3 μm or less.

15. An electrophotographic photosensitive member according to claim 2, wherein when the area of the plurality of depressed portions is measured in the square region 500 μm on a side arranged at each of 50 arbitrary locations of the surface of the electrophotographic photosensitive member, a standard deviation of measured values for the area of the plurality of depressed portions at the 50 arbitrary locations is 5% or less.

16. An electrophotographic photosensitive member according to claim 2, wherein the plurality of line grooves have a depth of 0.01 μm or more and 0.05 μm or less on average.

17. A process cartridge, comprising:

the electrophotographic photosensitive member according to claim 2; and a cleaning unit including a cleaning blade arranged so as to be brought into contact with the electrophotographic photosensitive member, the electrophotographic photosensitive member and the cleaning unit being integrally supported, wherein the process cartridge is removably mounted onto a main body of an electrophotographic apparatus.

18. An electrophotographic apparatus, comprising:

the electrophotographic photosensitive member according to claim 2;

a charging unit;

an exposing unit;

a developing unit;

a transferring unit; and a cleaning unit including a cleaning blade arranged so as to be brought into contact with the electrophotographic photosensitive member.

* * * * *